US008638224B2

(12) United States Patent
Park

(10) Patent No.: US 8,638,224 B2
(45) Date of Patent: Jan. 28, 2014

(54) REFRIGERATOR AND METHOD OF OPERATING THE SAME

(75) Inventor: Su Re Park, Seoul (KR)

(73) Assignee: LG Electronics Inc., Seoul (KR)

( * ) Notice: Subject to any disclaimer, the term of this patent is extended or adjusted under 35 U.S.C. 154(b) by 439 days.

(21) Appl. No.: 12/827,460

(22) Filed: Jun. 30, 2010

(65) Prior Publication Data

US 2011/0016910 A1 Jan. 27, 2011

(30) Foreign Application Priority Data

Jul. 21, 2009 (KR) ..... 10-2009-0066498

(51) Int. Cl.
*F25D 23/02* (2006.01)
*G08B 21/22* (2006.01)
*G08B 21/18* (2006.01)

(52) U.S. Cl.
USPC ..... 340/540; 340/603; 340/612; 340/613; 340/614; 705/22; 705/23

(58) Field of Classification Search
None
See application file for complete search history.

(56) References Cited

U.S. PATENT DOCUMENTS

| | | | | |
|---|---|---|---|---|
| 3,694,594 | A * | 9/1972 | Breed | 200/61.47 |
| 4,781,111 | A * | 11/1988 | Chesnut | 100/99 |
| 6,741,180 | B2 * | 5/2004 | Lassota | 340/622 |
| 7,661,448 | B2 * | 2/2010 | Kim et al. | 141/94 |
| 7,663,497 | B2 * | 2/2010 | Chishima et al. | 340/686.1 |
| 7,844,509 | B2 * | 11/2010 | Bodin et al. | 705/29 |
| 7,937,289 | B2 * | 5/2011 | Bodin et al. | 705/22 |
| 8,477,029 | B2 * | 7/2013 | Ashrafzadeh et al. | 340/540 |
| 2002/0178066 | A1 * | 11/2002 | Roh et al. | 705/22 |
| 2003/0131541 | A1 | 7/2003 | Lee et al. | |
| 2008/0052037 | A1 * | 2/2008 | Bodin et al. | 702/173 |
| 2008/0052200 | A1 * | 2/2008 | Bodin et al. | 705/28 |
| 2008/0052201 | A1 * | 2/2008 | Bodin et al. | 705/28 |
| 2008/0052202 | A1 * | 2/2008 | Bodin et al. | 705/28 |
| 2008/0250797 | A1 * | 10/2008 | Rozendaal et al. | 62/127 |
| 2009/0213582 | A1 * | 8/2009 | Thomas | 362/183 |
| 2009/0277199 | A1 * | 11/2009 | Manas et al. | 62/129 |
| 2010/0061048 | A1 * | 3/2010 | Mills | 361/679.21 |

FOREIGN PATENT DOCUMENTS

| | | |
|---|---|---|
| CN | 1388348 | 1/2003 |
| CN | 1423106 A | 6/2003 |
| CN | 2921731 Y | 7/2007 |

(Continued)

OTHER PUBLICATIONS

International Search Report issued in PCT Application No. PCT/KR2010/004626 dated Feb. 18, 2011.

(Continued)

*Primary Examiner* — Benjamin C Lee
*Assistant Examiner* — Rajsheed Black-Childress
(74) *Attorney, Agent, or Firm* — Ked & Associates, LLP

(57) ABSTRACT

A refrigerator may include a main body having a storage chamber formed therein, a cooling device for cooling the storage chamber, and a door for opening and closing the storage chamber. A basket may be installed at the door and a pressure sensor may be provided on the basket to detect a pressure applied by a storage item stored in the basket. A controller may output a control signal based on the pressure detected by the pressure sensor to a display that displays a residual amount of the item stored in the refrigerator.

14 Claims, 19 Drawing Sheets

(56) References Cited

FOREIGN PATENT DOCUMENTS

| | | |
|---|---|---|
| JP | 2000-111238 | 4/2000 |
| JP | 2000-274923 | 10/2000 |
| JP | 2002-267352 | 9/2002 |
| KR | 10-2006-0125016 | 12/2006 |
| KR | 10-0767842 | 10/2007 |

OTHER PUBLICATIONS

Chinese Office Action issued in Application No. 201080036376.8, dated Aug. 12, 2013.

Chinese Office Action issued in Application No. 201080036177.7 dated Sep. 26, 2013.

* cited by examiner

REFRIGERATOR AND METHOD OF OPERATING THE SAME

CROSS-REFERENCE TO RELATED APPLICATION(S)

This application claims priority under 35 U.S.C. §119 to Korean Application No. 10-2009-0066498, filed in Korea on Jul. 21, 2009, the entirety of which is incorporated herein by reference.

BACKGROUND

1. Field

This relates to a refrigerator and a method of operating a refrigerator.

2. Background

In general, a refrigerator cools a storage chamber such as a refrigerating chamber and a freezing chamber using a refrigeration cycle device including a compressor, a condenser, an expansion device, and an evaporator. Items may be stored in a basket installed at a door of the refrigerating or freezing chamber and a shelf installed in the refrigerating or freezing chamber.

In such a refrigerator, a part of a freezing chamber door or a refrigerating chamber door may be transparent so that the inside of the freezing chamber or the refrigerating chamber and items stored therein may be viewed from the outside, without opening the door. However, users may prefer that the interior of the refrigerator not always be visible. Further, if a container stored in the refrigerator is opaque, it is not easy to determine an amount remaining in the container without removing the container from the refrigerator, even if the container is visible from the outside.

BRIEF DESCRIPTION OF THE DRAWINGS

The embodiments will be described in detail with reference to the following drawings in which like reference numerals refer to like elements wherein.

DETAILED DESCRIPTION

Hereinafter, exemplary embodiments of a refrigerator and a method of operating the same will be described in detail with reference to the accompanying drawings.

Figure 1:
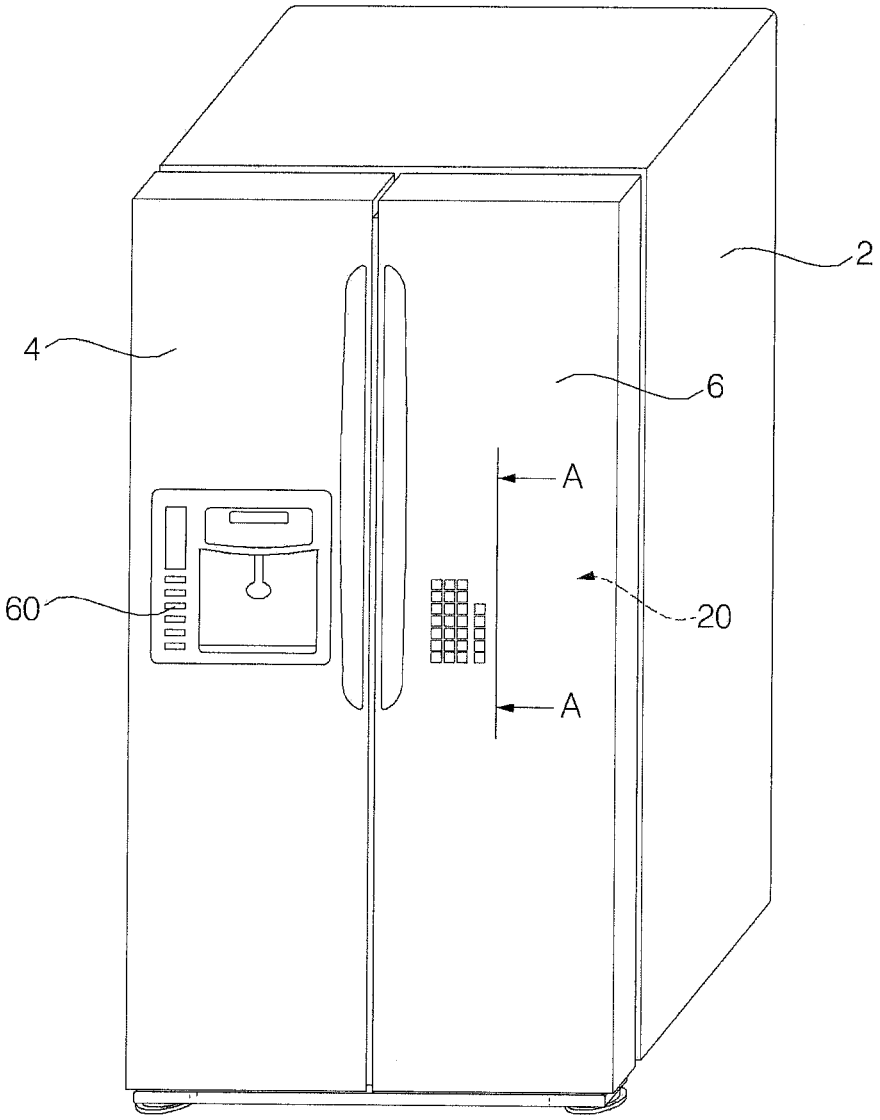
FIG. 1 is a perspective view of a refrigerator according to an exemplary embodiment as broadly described herein.
Figure 2:
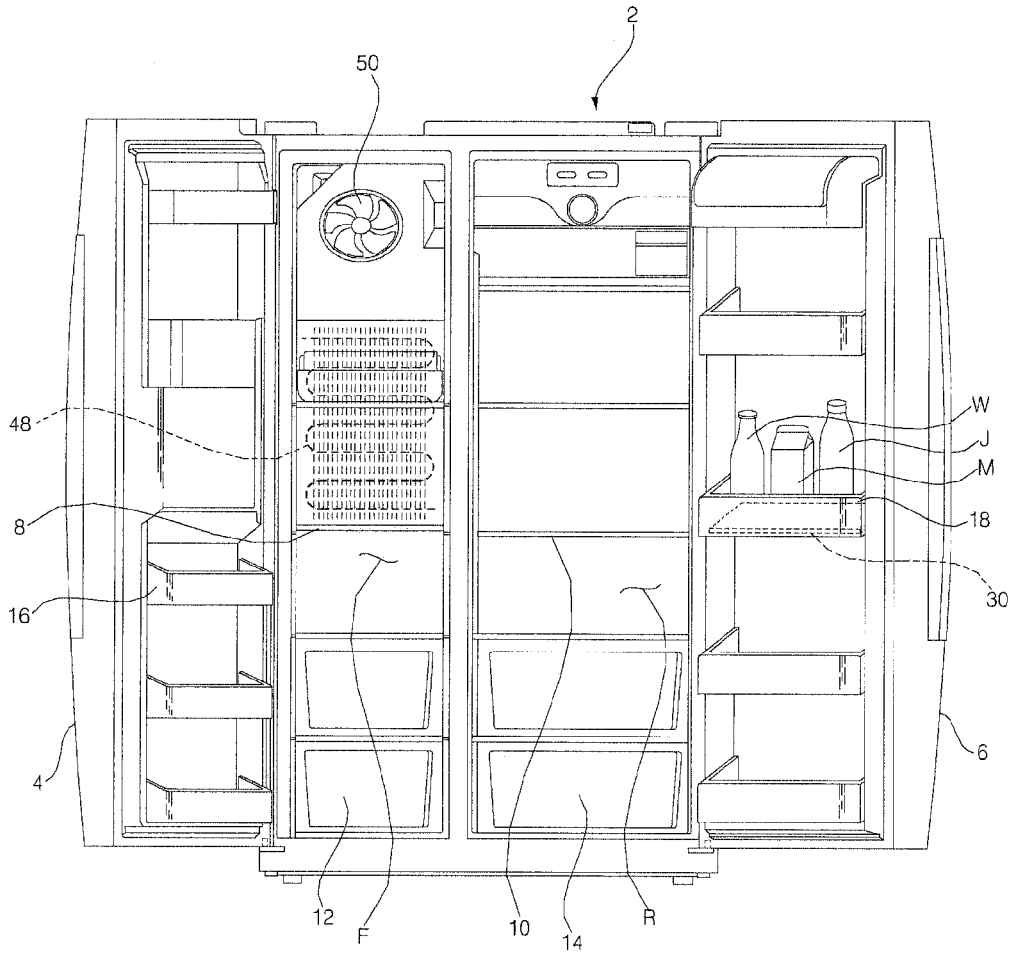
FIG. 2 is a front interior view of the refrigerator shown in FIG. 1.
Figure 3:
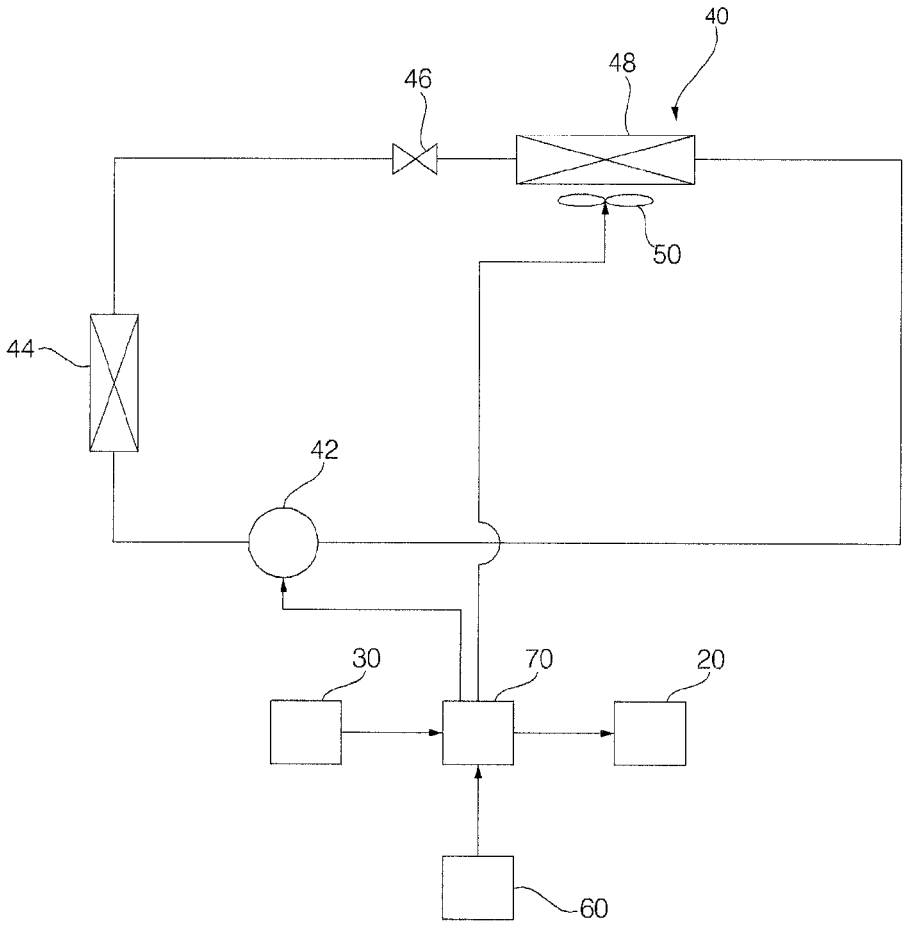
FIG. 3 is a schematic diagram of the refrigerator shown in FIG. 1.

As shown in FIGS. 1-3, a refrigerator as embodied and broadly described herein may include a main body 2 having storage chambers F and R formed therein and doors 4 and 6 for opening and closing the storage chambers F and R. A cooling device 40 for cooling the storage chambers F and R may be installed at the main body 2. Shelves 8 and 10 and drawers 12 and 14 may be provided within the storage chambers F and R for receiving items for storage in the refrigerator.

The doors 4 and 6 may rotate in one of a lateral direction or a vertical direction with respect to the main body 2. When the doors 4 and 6 are closed, baskets 16 and 18 may be vertically arranged on the doors 4 and 6 for receiving storage items J, M, and W, and may be positioned facing toward an interior of the storage chambers F and R. Simply for ease of discussion, in this exemplary embodiment, the storage items may be beverages, such as, for example, juice, milk and water. However, it is well understood that the storage items could be other beverages or liquids, condiments, dessert items such as ice cream, or any other storage item that could be stored in the baskets 16 and 18 provided on the interior sides of the doors 4 and 6.

In this exemplary embodiment, the storage chambers F and R include a freezing chamber F and a refrigerating chamber R, and the doors 4 and 6 include a freezing chamber door 4 for opening and closing the freezing chamber F and a refrigerating chamber door 6 for opening and closing the refrigerating chamber R. Similarly, the shelves 8 and 10 include one or more freezing chamber shelves 8 disposed at the freezing chamber F and one or more refrigerating chamber shelves 10 disposed at the refrigerating chamber R, and the baskets 16 and 18 include one or more freezing chamber baskets 16 for storing frozen items, and one or more refrigerating chamber baskets 18 for storing cold-storage items such as, for example, beverages J, M, and W such as juice, milk, water, liquor and other such items.

The refrigerator according to this exemplary embodiment may include an amount detection device for detecting a residual amount of a particular storage item stored in the refrigerator, and a display 20 for displaying a residual amount detected by the amount detection device. As discussed above, simply for ease of discussion, the storage items in this exemplary embodiment are beverages, and thus the amount detection device will detect a residual amount of a beverage remaining in a particular container. However, the amount detection device could also detect a residual amount of other storage items stored in the refrigerator in a similar manner.

The amount detection device may be installed at the shelves 8 and 10 to detect a residual amount of, for example, a beverage, stored on the shelves 8 and 10, may be installed at the drawers 12 and 14 to detect a residual amount of a storage item stored in the drawers 12 and 14, and may be installed at the baskets 16 and 18 to detect a residual amount of a storage item stored in the baskets 16 and 18. In this exemplary embodiment, the amount detection device will be installed at the baskets 16 and 18.

The amount detection device may include a pressure sensor 30 for detecting a pressure applied by the beverages J, M, and W in order to detect an amount of the beverages J, M, and W remaining in their respective containers. In the alternative embodiments, the amount detection device may include an optical sensor for radiating light toward the beverages J, M, and W in order to detect a fluid level in the beverage containers to determine a residual beverage amount. Such an optical sensor may require that the beverage containers be somewhat transparent. In contrast, a pressure sensor 30 may detect a residual container beverage amount regardless of whether a container bottle is opaque or transparent.

The pressure sensor 30 may be installed at each of the plurality of baskets 16 and 18, and the display 20 may display an amount of one or more beverages stored at each of the baskets 16 and 18 individually. Simply for ease of discussion, in this example, the pressure sensor 30 is installed at one of the baskets 18, and the display 20 displays an amount of the beverages J, M, and W stored in the basket 18 in which the pressure sensor 30 is installed. It is well understood that, when the pressure sensor 30 is installed at one of the freezing chamber baskets 16 to detect an amount of a storage item in the freezing chamber basket 16, the display 20 may display a corresponding amount stored in the freezing chamber basket 16, and when the pressure sensor 30 is also installed at one of the refrigerating chamber baskets 18 to detect an amount of a storage item in the refrigerating chamber basket 18, the display 20 may display a corresponding amount stored in the refrigerating chamber basket 18, based on user preferences.

The pressure sensor 30 may detect an entire pressure applied by all of the items/beverages stored in the basket 18 and the display 20 may display a total amount of all of the items/beverages. Alternatively, the pressure sensor 30 may detect a pressure of each individual item/beverage stored in the basket 18 and the display 20 may display an amount of each item/beverage individually. In the exemplary embodiment discussed hereinafter, the pressure sensor 30 is installed at one basket 18 to detect a pressure of each of a plurality of beverages J, M, and W, individually and the display 20 displays an amount of each of the plurality of beverages, J, M, and W individually.

The pressure sensor 30 may be, for example, a mechanical pressure sensor, an electrical pressure sensor, an electronic pressure sensor, or other type of sensor as appropriate. In this embodiment, the pressure sensor 30 is formed as an assembly of a plurality of pressure detection elements in order to more accurately detect a pressure of a beverage at a particular storage position and area.

The display 20 may display an amount of the beverages J, M, and W using, for example, a numeral such as a percent, or may display an amount of the beverages J, M, and W using a diagram such as, for example, a bar graph. In this embodiment, an amount of the beverages J, M, and W is displayed in a bar graph to easily discern a remaining amount using the naked eye at a relatively long distance. In this example, a plurality of beverages J, M, and W are stored in the basket 18 at different areas, and beverage amounts are displayed together using a width/length/height of a bar graph.

In certain embodiments, the display 20 may display a bar graph having a size corresponding to that of the detected beverage amount. Alternatively, the display 20 may display a bar graph having a larger size for easier viewing at a long distance.

The display 20 may be installed at the main body 2 or at one of the doors 4 and 6. In this exemplary embodiment, the display 20 is installed at one of the doors 4 and 6 to easily view the display information and to allow the size of display information to be enlarged.

In particular, the display 20 is installed at the front of the door 6 corresponding to a position of the basket 18 in which the pressure sensor 30 is installed, and may be include an LED assembly for displaying various information or a touch panel LCD assembly for receiving various operating instructions in response to a user touch and displaying various information. In this exemplary embodiment, the display 20 including an LED assembly will be described.

As shown in FIG. 3, in a refrigerator according to the present exemplary embodiment, the cooling device 40 may include a compressor 42, a condenser 44, an expansion device 46, and an evaporator 48. A refrigerant circulates through the compressor 42, the condenser 44, the expansion device 46, and into the evaporator 48 for cooling, and then back to the compressor 40. The evaporator 48 may contact an outer wall of the storage chambers F and R to directly cool the storage chambers F and R, and may include a cooling air circulation fan 50 for circulating air between the evaporator 48 and the storage chambers F and R.

The refrigerator may also include a manipulation device 60 that allows a user to input various operating instructions, and a controller 70 for controlling operation of the refrigerator, particularly the compressor 42, the cool air circulation fan 50, and the display 20, based on input received by the manipulation device 60. The manipulation device 60 may include an operation/stop input device for turning on/off the refrigerator, a temperature setting device for setting a freezing setting temperature or a refrigerating setting temperature of the refrigerator, an expiration period input device for inputting an expiration period of a storage item, such as, for example, a beverage, an amount display time input device for inputting an amount display time period for the display 20, a specific area non-display input device for inputting a command so that an amount of an item stored at a specific area of the basket 18 is not displayed, and an initialization input device for initializing a pressure detected by the pressure sensor 30.

The controller 70 controls the display 20 based on information detected by the pressure sensor 30 together with the input received by the manipulation device 60. In particular, the controller 70 outputs a control signal for controlling the display 20 based on information detected by the pressure sensor 30, and the display 20 displays a corresponding amount based on the control signal output by the controller 70. The controller 70 may calculate a remaining amount of a particular storage item, such as, for example, a beverage amount, using a detection pressure detected by the pressure sensor 30, and output a corresponding control signal to the display 20. For example, the controller 70 may calculate a beverage amount as a height H, and output a control signal corresponding to the calculated height to the display 20. The controller 70 may also calculate a beverage weight G corresponding to a detection pressure from a pressure detected by the pressure sensor 30, calculate a volume V of a beverage by dividing the calculated weight G converted to a corresponding mass by a set density D of the particular beverage, and then calculate a corresponding beverage height H by dividing the calculated volume V by a beverage area A (the relationship of weight and mass through standard conversion based on the assumption of a constant acceleration rate due to gravity being well understood and understanding that density, which is measured in mass per unit volume, could be readily used to determine volume if density and weight, converted to mass, are known).

The set density D of the beverage may be a density of water, juice, milk or other beverage consumed in a common home. In certain embodiments, the set density D may be set to an average density of water, juice, and milk. For example, if it is assumed that a density of water is 1.00 g/ml, a density of a carbonated beverage is 1.11 g/ml, a density of fruit juice is 1.063 g/ml, and a density of milk is 1.03 g/ml, a set density D of about 1.05 g/ml may be used, which is an average of the density of water, a carbonated beverage, fruit juice, and milk. The set density D of a beverage may be previously stored in the controller 70 and used when calculating a beverage amount.

The beverage area A may be set to an average area value of beverages usually stored in the refrigerator, and may be calculated from the detected result of the pressure sensor 30.

Figure 4:
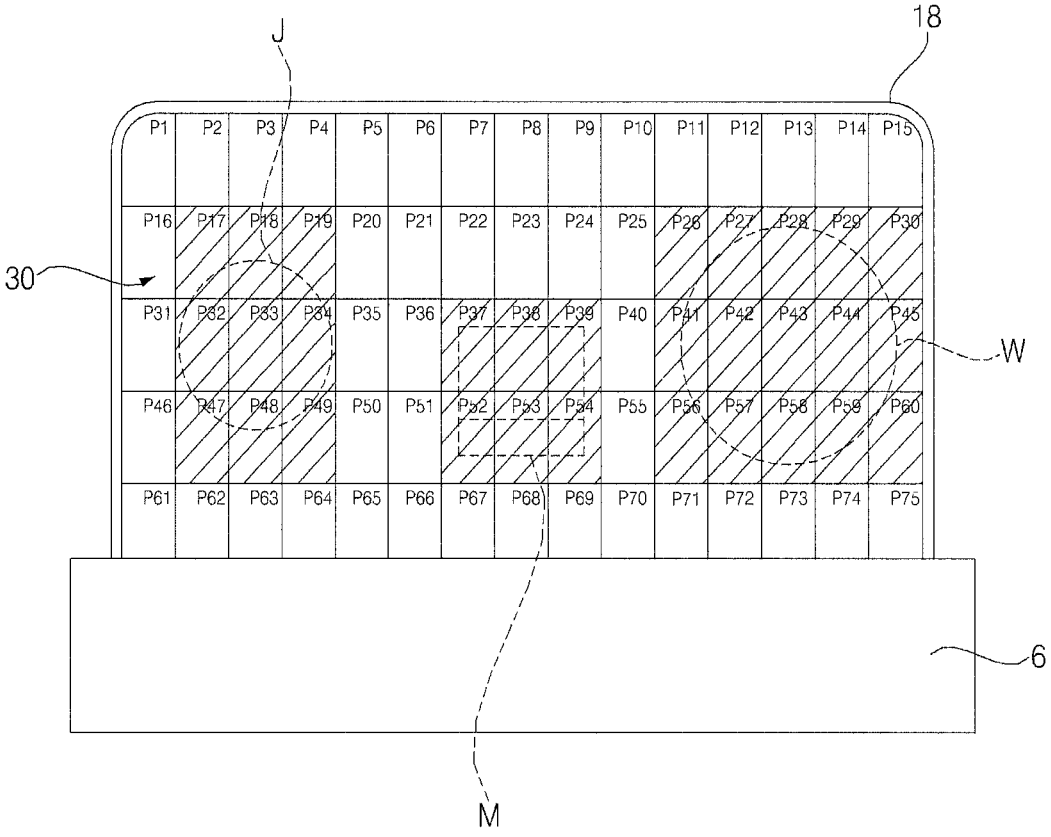
FIG. 4 is a top plan view of an exemplary pressure sensor of the refrigerator shown in FIG. 1.

As shown in FIG. 4, which is a top plan view of such a pressure sensor 30, the pressure sensor 30 may include a plurality of pressure detection elements P1 to P75 disposed in a plurality of rows and a plurality of columns. The plurality of pressure detection elements P1 to P75 may be positioned at a lower portion of the basket 18. In FIG. 4, pressure detection elements in which a pressure is detected (based on the storage items J, M and W positioned thereon) are shown in cross hatching. If a pressure is detected in one or more of these pressure detection elements P1 to P75, the controller 70 calculates a beverage area A from positions (or a coordinate value) of pressure detection elements in which a pressure is detected. The controller 70 calculates a beverage height H using a pressure detected by the pressure detection element and a calculated area A, and the display 20 displays a corresponding amount of beverages J, M, and W with a corresponding height and area.

In this example, the controller 70 determines positions of the pressure detection elements P17 to P19, P32 to P34, P47 to 49, P37 to P39, P52 to P54, P26 to P30, P41 to 45, and P56 to P60 that have detected a pressure applied thereto, and calculates corresponding beverage areas based on the position of these elements. If the outermost pressure detection elements of a particular set of pressure detection elements in which a pressure is detected form a closed loop, the controller 70 determines that a beverage is positioned on the pressure detection elements forming this closed loop and those positioned within this closed loop, and calculates an area corresponding to the quantity of the pressure detection elements.

In example shown in FIG. 4, one beverage J is positioned on nine pressure detection elements, another beverage M is positioned on six pressure detection elements, and another beverage W is positioned on 15 pressure detection elements. The controller 70 determines an area of the beverage W on the 15 pressure detection elements as 'a first area', an area of the beverage J on the 9 pressure detection elements as 'a second area, and an area of a beverage M on the 6 pressure detection elements as 'a third area'. The controller 70 then calculates a weight G of each of the beverages J, M, and W corresponding to a detection pressure from each of pressures detected by the pressure detection elements, calculates a volume V of the respective beverage by dividing each calculated weight G which has been converted to a corresponding mass by a set density D of the beverages J, M, and W, and calculates a height H of each beverage by dividing the respective calculated volume V by the respective area A.

In this example, the controller 70 calculates the weight G of each of the beverages J, M, and W corresponding to the sum of pressures detected by a plurality of pressure detection elements forming a closed loop, i.e., the pressure detection elements to which the particular beverage applies a pressure. The controller 70 outputs a control signal corresponding to a height H of each of the beverages J, M, and W to the display 20, and the display 20 displays an amount corresponding to a height H of each of the beverages J, M, and W as a height of a bar graph. The controller 70 may also display an area A as a width, in a lateral direction of the bar graph, for each of the beverages J, M and W.

Figure 5:
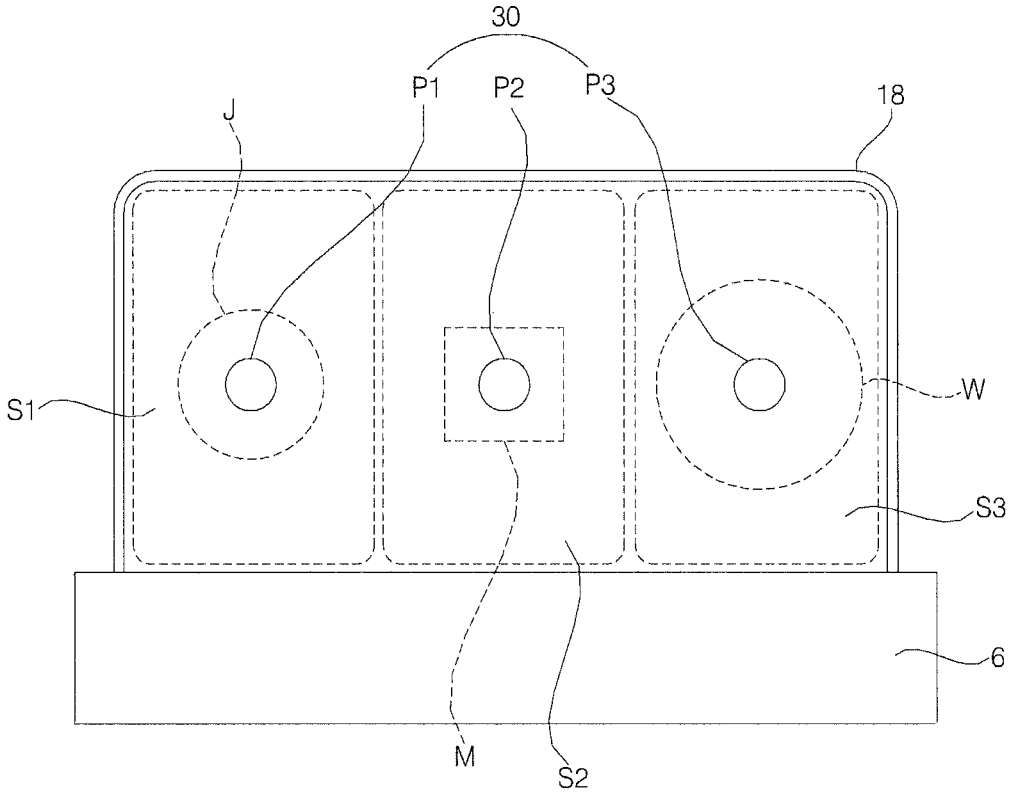
FIG. 5 is a top plan view of another exemplary pressure sensor of the refrigerator shown in FIG. 1.

FIG. 5 is a top plan view of another exemplary pressure sensor 30, including a plurality of pressure detection elements P1, P2, and P3. In this embodiment, the pressure sensors 30 are arranged separately, in a lateral direction or in a front-rear direction of the basket 18. For this purpose, an inner space of the basket 18 may be partitioned into a plurality of areas S1, S2, and S3 in the lateral direction or the front-rear direction, with the pressure detection elements P1, P2, and P3 respectively positioned in the plurality of areas S1, S2, and S3. A pressure detected by each of the pressure detection elements P1, P2, and P3 is output to the controller 70.

The controller 70 calculates the weight G of each of the beverages J, M, and W corresponding to the pressure detected by each of the pressure detection elements P1, P2, and P3, calculates a volume V of each beverage by dividing the calculated weight G which has been converted to a corresponding mass by a set density D of the beverages J, M, and W, and calculates a height H of each beverage by dividing each of the calculated volumes V by a beverage area A. The beverage area A may an average area value of beverages usually stored in the refrigerator, or a specific area A for a particular storage location and/or beverage type, as appropriate. The controller 70 outputs a control signal corresponding to the height H of each of the beverages J, M, and W to the display 20, and the display 20 displays an amount of the beverages J, M, and W at each of the areas S1, S2, and S3 as a height.

If a pressure is not detected by one (or more) of the pressure detection elements P1, P2, and P3, the controller 70 only calculates an amount and height of a beverage positioned at an area in which a pressure is detected, and the display 20 only displays a beverage amount corresponding to an area in which a pressure is detected. That is, the controller 70 calculates a beverage amount by partitioning the basket 18 into the plurality of areas S1, S2, and S3, and the display 20 independently displays a beverage amount according to beverages detected by each of the pressure detection elements P1, P2 and P3 in the areas S1, S2 and S3.

Figure 6:
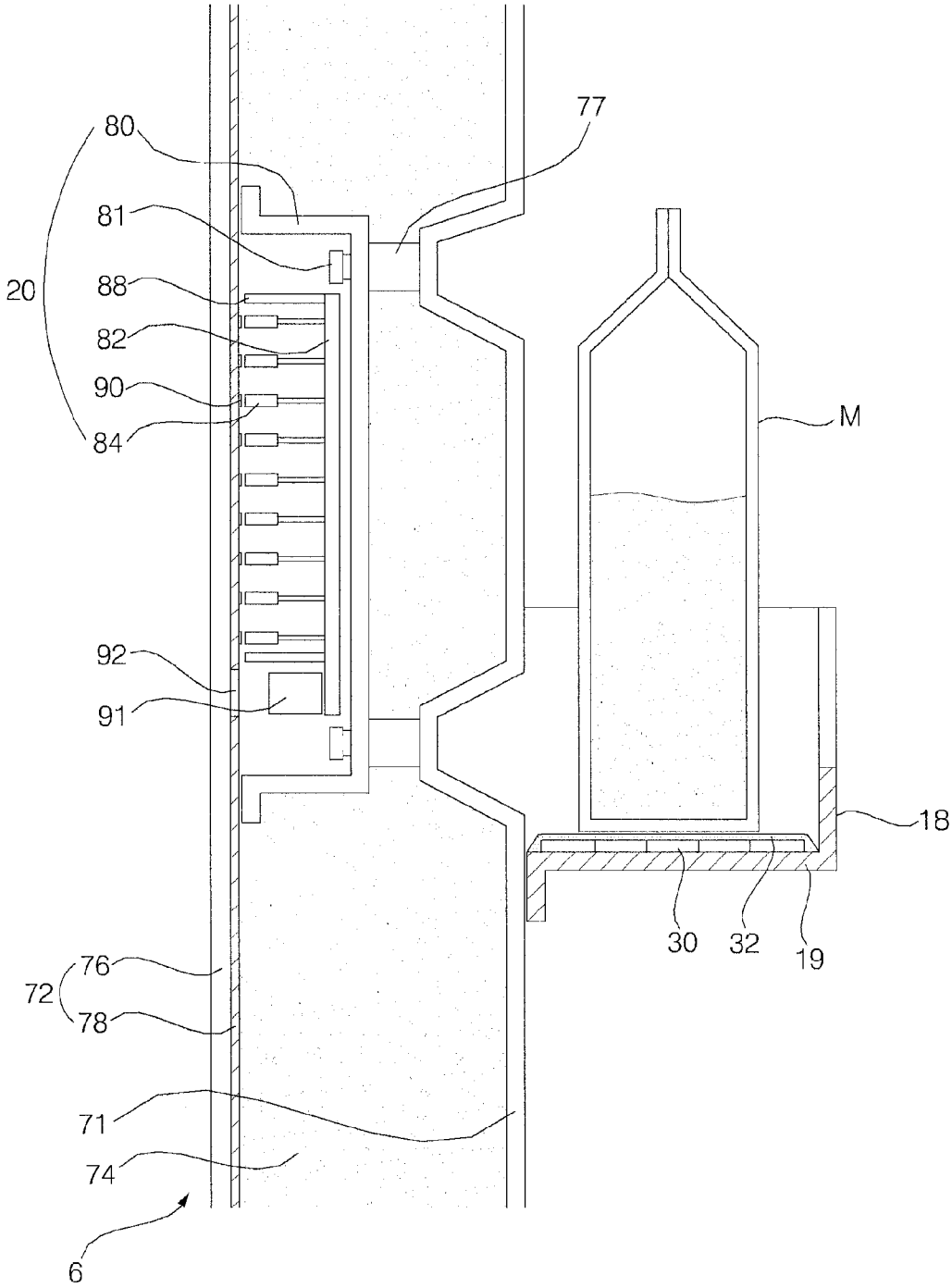
FIG. 6 is a cross-sectional view taken along line A-A of FIG. 1.
Figure 7:
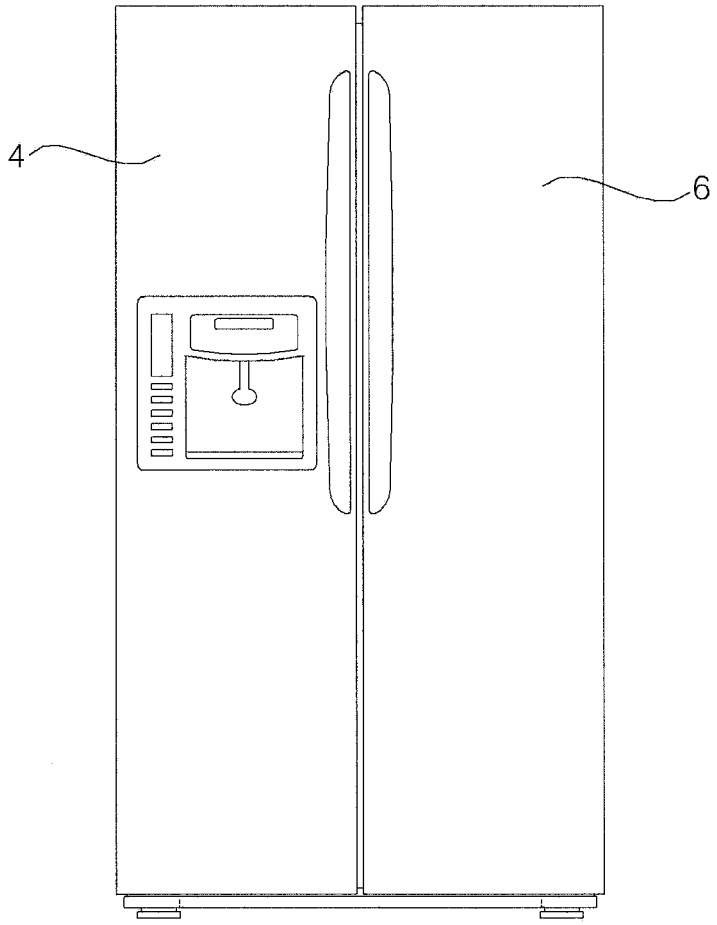
FIG. 7 is a front view of the refrigerator shown in FIG. 1, in which a display does not display a remaining item amount.
Figure 8:
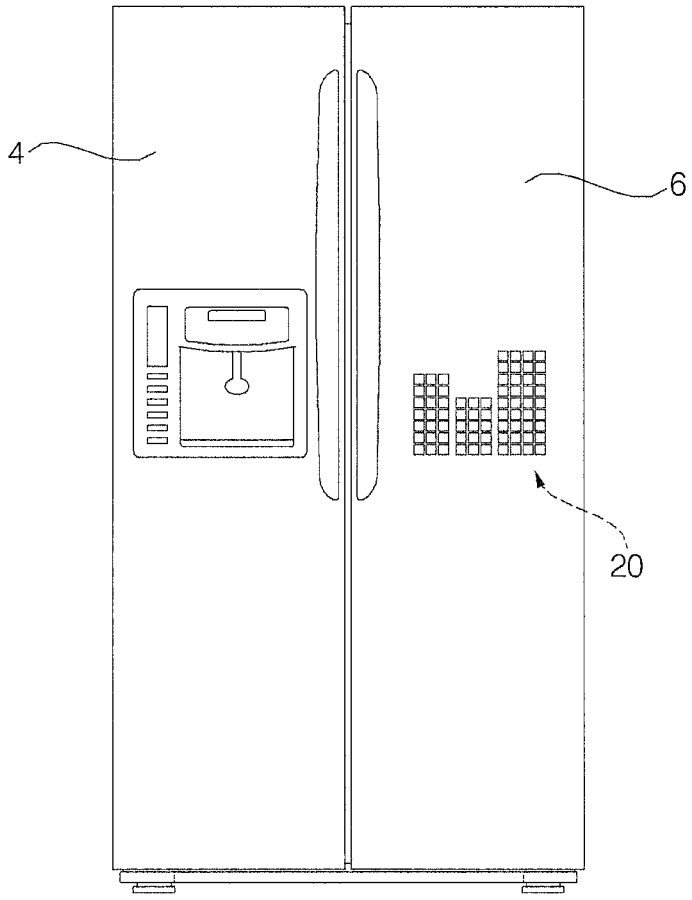
FIG. 8 is a front view of the refrigerator shown in FIG. 1, in which a display displays a remaining item amount.
Figure 9:
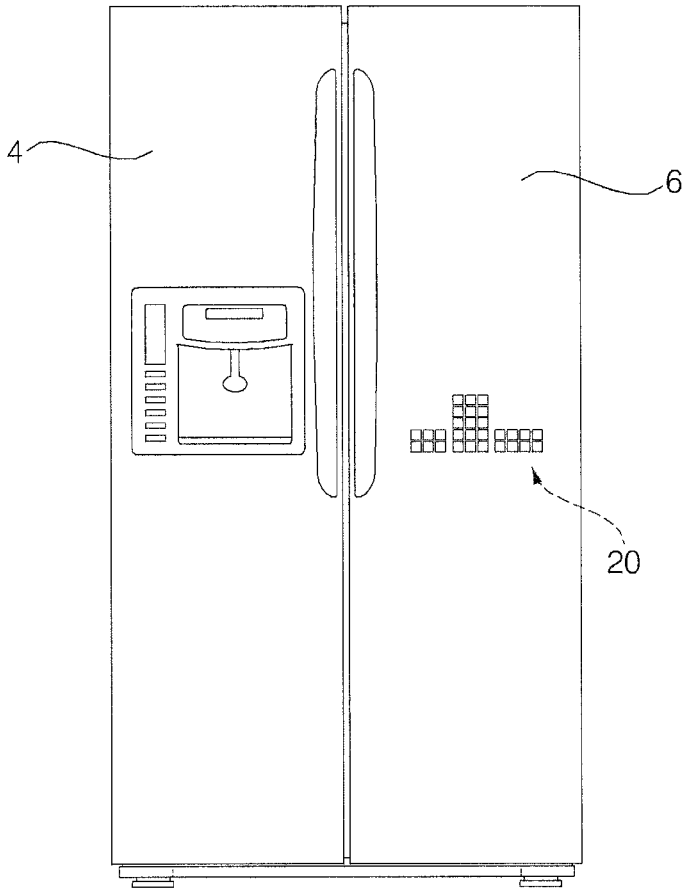
FIG. 9 is a front view of the refrigerator shown in FIG. 1, in which a display indicates that a remaining item amount is small.

FIG. 6 is a cross-sectional view taken along line A-A of FIG. 1, FIG. 7 is a front view of the refrigerator shown in FIG. 1, illustrating a case in which the display 20 does not display an amount of a beverage remaining in the refrigerator, FIG. 8 is a front view of the refrigerator shown in FIG. 1, illustrating a case in which the display 20 displays a large amount of beverage remaining in the refrigerator, and FIG. 9 is a front view of the refrigerator shown in FIG. 1, illustrating a case in which the display 20 displays a small amount of beverage remaining in the refrigerator.

As shown in FIG. 6, the basket 18 is installed on a rear surface of the door 6 and protrudes toward the storage chamber when the door 6 is closed. The basket 18 includes a lower plate 19 on which an item, such as a beverage, may be positioned. The pressure sensor 30 may be installed at one of an upper surface, a lower surface, or within the lower plate 19 of the basket 18.

When the pressure sensor 30 is installed at an upper surface of the lower plate 19 of the basket 18, an insulating member or a waterproof member 32 may cover an upper surface of the pressure sensor 30 so that liquid that leaks from the beverage container does not contact the pressure sensor 30. Similarly, when the pressure sensor 30 is installed at a lower surface of the lower plate 19 of the basket 18, an insulating member or a waterproof member may cover the lower surface of the pressure sensor 30 to avoid erroneous operation or damage to the pressure sensor 30 that may occur when the pressure sensor 30 is exposed to the storage chamber. When the pressure sensor 30 is installed within the lower plate 19 of the basket 18, the lower plate 19 may have a dual structure including an upper plate and a low plate, with the pressure sensor 30 provided between the upper plate and the lower plate.

In alternative embodiments, the pressure sensor 30 may be installed in an opening in the basket 18 so as to directly detect a pressure of a beverage while also supporting the beverage. In this case, the basket 18 may also include an upper insulating member or an upper waterproof member that covers an upper surface of the pressure sensor 30 and a lower insulating member or a lower waterproof member that covers a lower surface of the pressure sensor 30.

The display 20 may be installed behind a front plate portion of the door 6 so that, when the display 20 is turned off, the display 20 is not visible through the front plate portion of the door 6, and when the display 20 is turned on, the display 20 radiates light through the front plate portion of the door 6.

The door 6 includes a rear door panel 71 that defines a rear surface of the door 6 and faces the interior of storage chamber when the door 6 is closed, and a front cover 72 that defines a front plate portion of the door 6 and a front surface of the door 6. Insulation material 74 is provided in a space formed between the rear door panel 71 and the front cover 72.

The front cover 72 includes a transparent member 76, and a decoration portion 78 positioned at either a front surface or a rear surface of the transparent member 76, or between the front cover 72 and the rear door panel 71. The transparent member 76 may be made of a glass material such as reinforced glass, or a synthetic resin such as transparent acryl. The transparent member 76 may enclose an outer circumferential edge of the rear door panel 71, and may be coupled to the rear door panel 71 by a coupling member that also defines an external circumferential edge of the door 6, and may be directly coupled to a coupling portion that protrudes from the rear door panel 71.

The decoration portion 78 may be visible through the transparent member 76, may have various patterns or colors, and may be positioned at the rear side of the transparent member 76. When the decoration portion 78 is positioned at the rear side of the transparent member 76, the decoration portion 78 provides an enhanced appearance to the transparent member 76 as it is viewed through the transparent member 76 when the display 20 is turned on. When the display 20 is turned off, the decoration portion 78 functions as a shielding portion for covering the display 20 at the front side of the display 20. The decoration portion 78 may be screen printed on the rear surface of the transparent member 76, or may be formed as a film, a sheet, or a plate body in which the printed portion is formed on the front surface thereof.

The display 20 includes a display case 80, a display PCB 82 installed in the display case 80, and a plurality of LEDs 84 installed on the display PCB 82. The display case 80 protects the display PCB 82 and the plurality of LEDs 84, and may have a box shape in which a front surface thereof is opened. The display case 80 may be fixed to one of the rear door panel 71, the front cover 72, or the insulation material 74, by a fastening member 81 such as, for example, a screw, or a latch portion such as a hook to a fastening portion 77 formed in the rear door panel 71 to allow for service of the display 20. A front end of display case 80 closely contacts the rear surface of the front cover 72.

The display PCB 82 is inserted into the inside of the display case 80 and is connected to a lead wire so as to receive and transmit power and a signal from and to the controller 70 shown in FIG. 3. The plurality of LEDs 84 are separated from each other in a lateral direction and a vertical direction on the display PCB 82. The plurality of LEDs 84 may be luminance variable LEDs in which a luminance level is varied, and/or color variable LEDs in which color varies.

The display 20 may include a light cover 88 for protecting the plurality of LEDs 84 and enclosing a periphery of the plurality of LEDs 84. The light cover 88 may have a substantially square or trapezoidal shape so as to enclose a periphery of the plurality of LEDs 84, and may be fastened by a fastening means such as a hook to the display PCB 82.

The door 6 may also include a light spreading device including a plurality of light transmitting portions 90 for spreading light radiated by the LEDs 84. If light is radiated by the LEDs 84, the light spreading device may be a screen that is brightly viewed by light radiated by the LEDs 84, and that is covered by the decoration portion 78 when light is not radiated. When light is radiated by the LEDs 84, a color of the light spreading device is brighter than that of the decoration portion 78, and particularly, a white-based color, so as to be brightly viewed through the decoration portion 78.

The light transmitting portions 90 may be formed on the rear surface of the decoration portion 78. The light transmitting portions 90 may have a bright color such as, for example, a white color, and may be formed as a light spreading sheet having a plurality of light transmitting portions 90 disposed at a rear surface of the decoration portion 78 or at a front surface of the display 20, and having a bright color such as, for example, a white color, and an opaque portion for darkening a periphery thereof. The light transmitting portions 90 may be formed to correspond one-to-one to the LEDs 84, and may be formed by printing or coating, such as screen printing, at the rear side of the decoration portion 78.

In the display 20, if power is applied by a control signal of the controller 70, light is radiated from an LED to which power is applied, and radiated light is spread while lighting the light transmitting portions 90, which are brightly viewed from the front side of the door 6 through the decoration portion 76 and the transparent member 78. However, light is not radiated from an LED to which power is not applied, and a corresponding light transmitting portion 90 is covered by the decoration portion 78 and is not viewed from the outside.

If the display 20 were to always display a beverage amount, power consumption would increase. At a time at which the user does not use the refrigerator or when the user is not near the refrigerator, the display 20 may be turned off for a specific period of time to minimize power consumption. When the user is near the refrigerator, the display 20 may be turned on. This may be done either manually or automatically.

If the user inputs a display time period (for example, 7 AM to 10 PM) through a display time input section of the manipulation device 60, the controller 70 outputs a control signal to the display 20 only during the time period input by the user. A timer may be provided within the controller 70 so that the controller 70 does not output a control signal to the display 20 at a time other than the time period input by the user.

When a display time period is input and the display 20 is controlled through the manipulation device 60, the LEDs 84 radiate light and the display 20 displays a corresponding amount only during the time period input by the user. The display 20 does not radiate light and is hidden by the front cover 72, particularly by the decoration portion 78, at times other than the time period input by the user.

Thus, the refrigerator provides convenience to the user while displaying the amount of beverage, or other item, remaining in the refrigerator at only a specific time period, and is hidden and has the appearance of a single body with the door 6 during a non-display time period to minimize power consumption.

In certain embodiments, a human body detection sensor 91 for detecting a human body may be installed at the refrigerator, so that the display 20 is turned on and displays the beverage amount only when a user is positioned near the refrigerator. When the user is not positioned near the refrigerator, the display 20 is turned off. The human body detection sensor 91 may detect, for example, heat and/or motion of a human body, and may include a heat sensor, an infrared rays sensor for detecting a position and movement of a human body, an image sensor for detecting an image of a human body, or other type(s) or combination(s) of sensors as appropriate. The human body detection sensor 91 may be installed at one side of the main body 2, at one of the doors 4 and 6, at the manipulation device 60 shown in FIG. 1, or at the display 20.

When the human body detection sensor 91 is installed at the display 20, the human body detection sensor 91 together with the LEDs 84 may be installed at the display PCB 82, or and may be installed at a separate PCB (not shown) installed separately from the display PCB 82 in the display case 80 and be connected by a lead wire to the controller 70.

The human body detection sensor 91 may direct infrared rays toward the front of the door 6 from the inside of the door 6, and an infrared rays transmitting device 92 for transmitting infrared rays may be provided at the door 6, particularly at the front cover 72.

The human body detection sensor 91 may be positioned behind a rear surface of the transparent member 76, aligned with an opening in the decoration portion 78 which defines the infrared rays transmitting device 92, sot that the human body detection sensor 91 may be protected by the transparent member 76. In alternative embodiments, a transparent portion of the decoration portion 78 may define the infrared rays transmitting device 92, and the human body detection sensor 91 may be protected by the transparent member 76 and the transparent portion of the decoration portion 78.

In alternative embodiments, the human body detection sensor 91 may detect a combination of motion and heat to prevent unintentional activation of the sensor 91 and the display.

Figure 10:
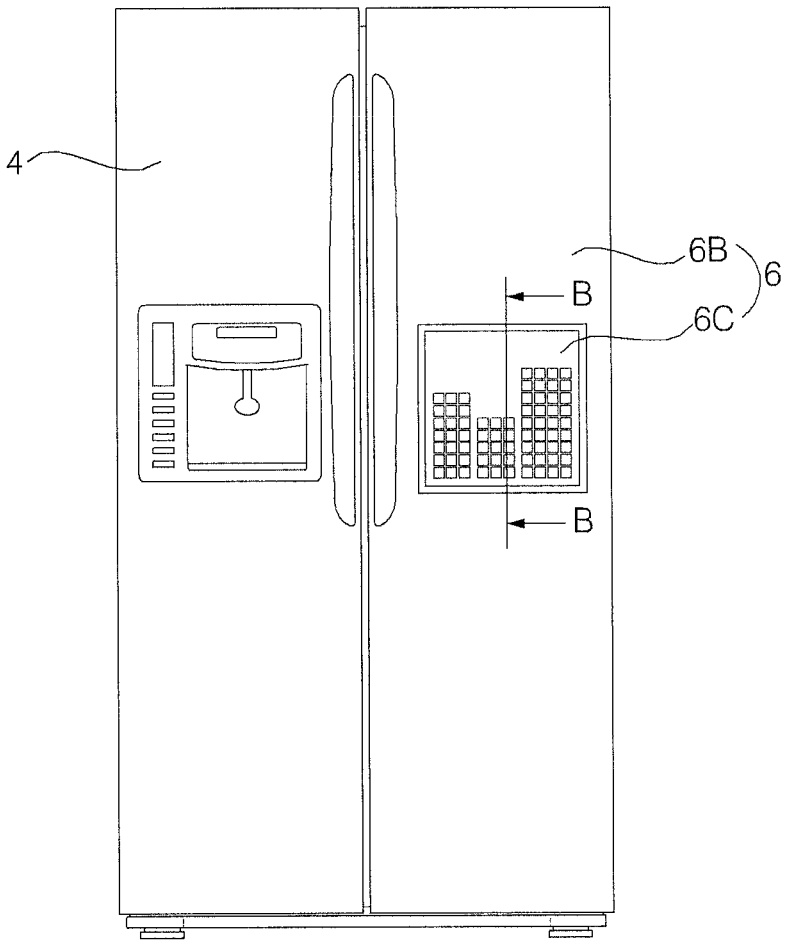
FIG. 10 is a front view of a refrigerator according to another exemplary embodiment as broadly described herein.
Figure 11:
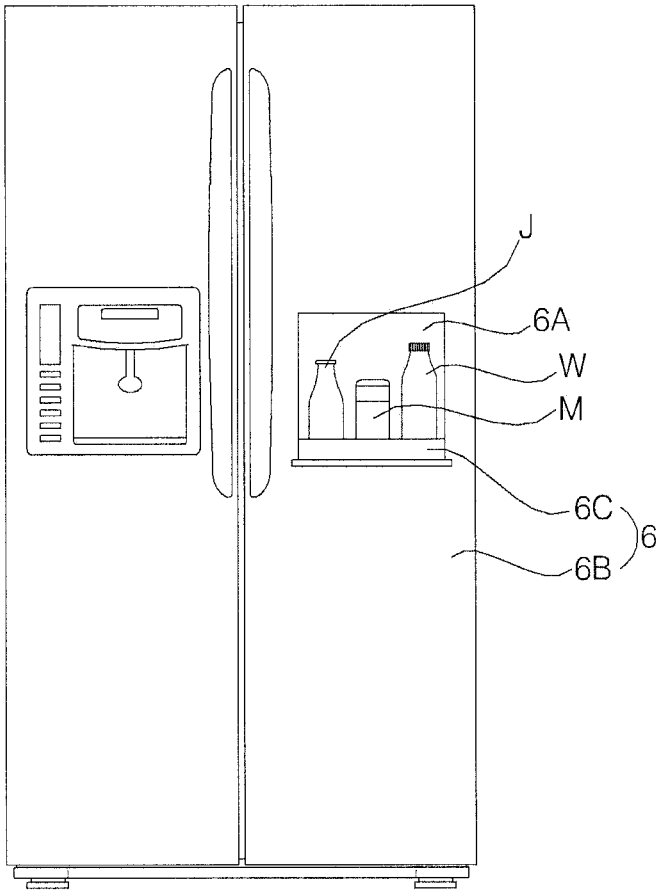
FIG. 11 is a front view of a refrigerator in which a home bar door of the refrigerator shown in FIG. 10 is rotated.
Figure 12:
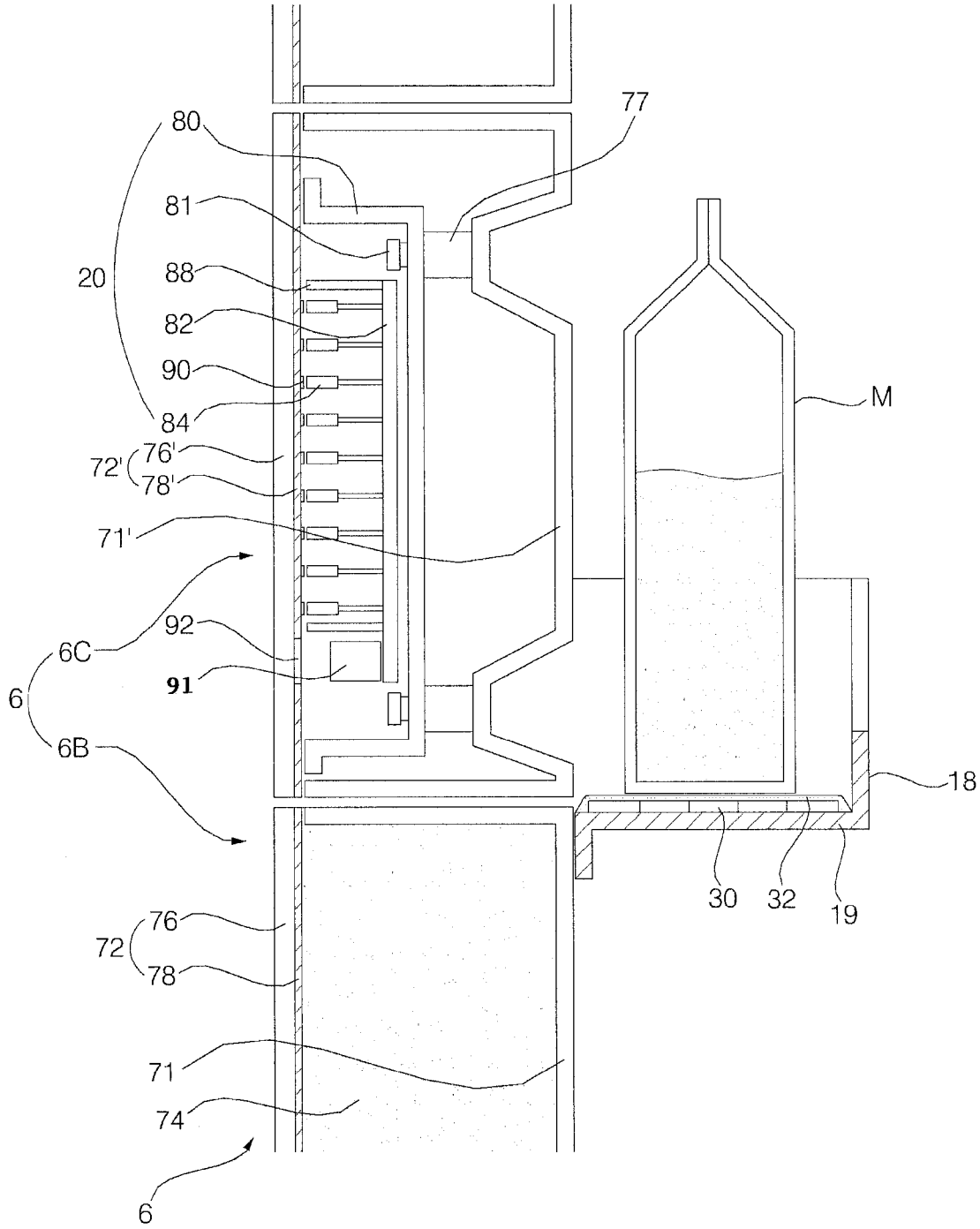
FIG. 12 is a cross-sectional view taken along line B-B of FIG. 10.

FIG. 10 is a front view of a refrigerator according to another exemplary embodiment, FIG. 11 is a front view of the refrigerator shown in FIG. 10, in which a home bar door is rotated, and FIG. 12 is a cross-sectional view taken along line B-B of FIG. 10.

As shown in FIGS. 10 to 12, the refrigerator according to this exemplary embodiment may include a main door 6B having an opening 6A formed therein, and a home bar door 6C installed in the main door 6B so as to open and close the opening 6A. The display 20 is installed in the home bar door 6C.

The main door 6B includes a rear door panel 71, a front cover 72, and insulation material 74 provided in the space formed therebetween. The home bar door 6C includes a home bar rear door panel 71' and a home bar front cover 72' disposed in front of the home bar rear door panel 71'. The home bar front cover 72' may include a transparent member 76' and a decoration portion 78'. The home bar rear door panel 71' defines an external surface of the home bar door 6B facing the inside of the storage chamber when the door 6 is closed, and the home bar front cover 72' defines an external surface of the front of the home bar door 6C facing the outside when the home bar door 6C is closed.

An installation space of the display 20 is formed between the home bar rear door panel 71' the home bar front cover 72', so that the display 20 closely contacts the rear surface of the home bar front cover 72'. A light spreading device including light transmitting portions 90 may be provided in the decoration portion 78' of the home bar front cover 72', as in the exemplary embodiment shown in FIG. 6.

In the refrigerator shown in FIG. 12, service may be performed by separating only the home bar door 6C from the main door 6B, without disassembling the entire door 6.

The basket 18 in which the pressure sensor 30 is installed is positioned at a lower portion of the opening 6A, so that if a user places a beverage into the basket 18 through the opening (when the home bar door 6C is rotated away from the main door 6B), the display 20 installed in the home bar door 6C displays an amount of a beverage positioned in the basket 18 once the home bar door 6C is returned to the closed position, thereby improving user convenience.

Figure 13:
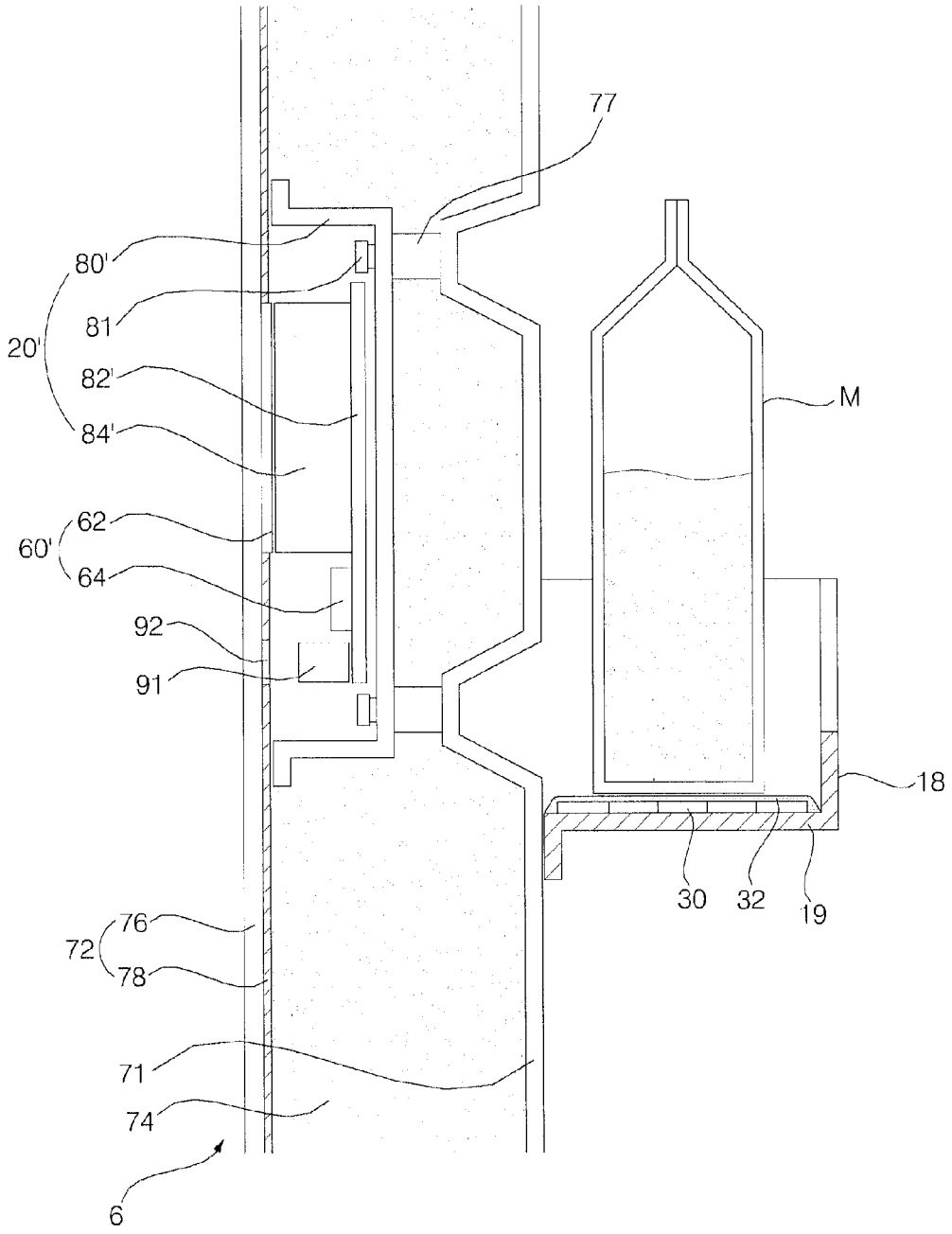
FIG. 13 is a cross-sectional view taken along line B-B of FIG. 10 according to another exemplary embodiment as broadly described herein.

FIG. 13 is a cross-sectional view of a refrigerator according to another exemplary embodiment. As shown in FIG. 13, a display 20' may include a touch panel LCD assembly and a manipulation device 60'. The display 20' includes a display case 80', a display PCB 82' and an LCD module 84' installed at the display PCB 82'. The display case 80' protects the display PCB 82' and the LCD module 84' and has a box shape with an open a front face. The manipulation device 60' includes a touch screen 62 positioned in front of the LCD module 84' and a coordinate recognition device 64 for recognizing a coordinate input to the touch screen 62.

The LCD module 84' corresponds to the plurality of LEDs 84 included in the embodiment, shown in FIG. 6, and may display a beverage amount in a bar graph, or may display a beverage amount with using numerals or various other symbols as appropriate.

The coordinate recognition device 64 of the manipulation device 60' may be installed separately from the display 20', or may be installed at the display 20'. When the coordinate recognition device 64 is installed at the display 20', the coordinate recognition device 64 together with the LCD module 84' may be installed at the display PCB 82', or may be installed at a separate PCB (not shown) installed in the display case 80', and may be connected by a lead wire to the controller 70.

The front side of the touch screen 62 may be transparent so that the LCD module 84' may be viewed through the touch screen 62 by the naked eye. The decoration portion 78 is not positioned in front of the touch screen 62 and the LCD module 84' so that information displayed by the LCD module 84' is visible through the touch screen 62 and the transparent member 76. In this exemplary embodiment, an opening is formed in the front cover 72, and the touch screen 62 of a touch panel LCD assembly may be installed in the opening so as to be exposed to the outside.

Figure 14:
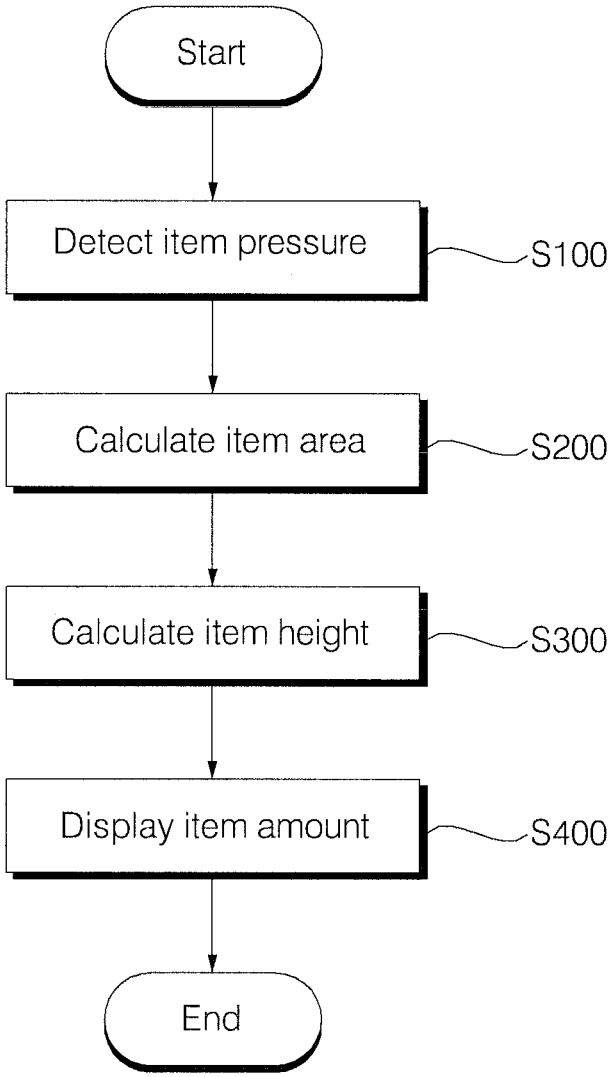
FIG. 14 is a flowchart of a method of operating a refrigerator according to an exemplary embodiment as broadly described herein.

FIG. 14 is a flowchart of a method of operating a refrigerator according to an exemplary embodiment as broadly described herein, including detecting a beverage amount (S100, S200, and S300) and displaying a beverage amount (S400). Simply for ease of discussion, the following description will be made with respect to a remaining amount of beverage stored in the refrigerator. However, similar principles may be applied to detecting remaining amounts of other items stored at the same or other locations in the refrigerator.

First, an amount detection device installed at the refrigerator detects a beverage pressure (S100) applied to a pressure detection element and/or a plurality of pressure detection elements of the pressure sensor of the amount detection device, and a signal corresponding to the detected pressure is output to the controller 70.

Processes of calculating a beverage amount (S200 and S300) include a process of calculating a beverage area (S200) and a process of calculating a beverage height (S300).

A beverage area is then calculated by the controller 70 (S200). In particular, the controller 70 determines a plurality of pressure detection elements in which a pressure is detected and a location thereof based on a signal input from a plurality of pressure detection elements. The controller 70 then determines whether the pressure detection elements in which a pressure is detected form a closed loop. When a closed loop is formed, the controller 70 calculates a beverage area based on the number of pressure detection elements that form the closed loop. For example, when 9 pressure detection elements form a closed loop, the controller 70 determines that a beverage is positioned on the 9 pressure detection elements that form closed loop and calculates an area corresponding to the 9 pressure detection elements that form the closed loop and any additional pressure detection elements that may be positioned within the closed loop.

The controller 70 may calculate an area corresponding to a particular quantity of pressure detection elements on a group basis. For example, if three separate pressure detection element groups (each forming separate closed loops) are detected, the controller 70 determines that there are three separate beverages stored, and calculates a corresponding area thereof for each beverage based on a corresponding grouping of pressure detection elements.

In the process of calculating a beverage height (S300), the controller 70 calculates beverage weights corresponding to a pressure detected by each of the groups of pressure detection elements. More specifically, the controller 70 calculates a beverage weight corresponding to the sum of pressures detected from a plurality of pressure detection elements forming a group. The controller 70 calculates a volume V of each beverage by dividing each of the calculated beverage weights which have been converted to corresponding masses by a beverage set density D, and then calculates a corresponding beverage height H for each beverage by dividing each calculated volume V by its respective beverage area A.

In the processes of calculating a beverage area and height to determine a beverage amount (S200 and S300), the controller 70 may also determine whether a container weight C should be considered or not, based on the detected result of the pressure sensor 30. In the process of calculating a beverage height (S300), if the calculated beverage weight is greater than or equal to a set value, the controller 70 determines that a beverage is contained within, for example, a glass container (which would affect weight), and calculates a value in which a set weight is subtracted from a calculated weight to calculate an actual amount of a beverage in the container.

The set weight may correspond to a weight of, for example, glass containers stored the refrigerator, and may be previously set and stored when manufacturing the refrigerator.

A height of a beverage in which a calculated weight of the beverage is greater than or equal to a set value may be calculated by Equation 1, and a height of a beverage in which a calculated weight of the beverage is less than a set value may be calculated by Equation 2.

$$H=(G-C)/D/A \quad \text{[Equation 1]}$$

$$H=G/DA \quad \text{[Equation 2]}$$

where H is a beverage height, G is a beverage weight calculated based on a pressure detected by a pressure detection element, C is a set weight, and D is a set density of a beverage.

A beverage amount is then displayed by the display 20 (S400). More specifically, a beverage amount may be displayed as a height H. The controller 70 outputs a control signal to the display 20, and the display 20 displays corresponding beverage amount(s). For example, if a large amount of beverage is stored, the display 20 displays a relatively high bar on the bar graph. If a small amount of beverage is stored, the display 20 displays a relatively low bar on the bar graph. Other indicators may also be appropriate.

In alternative embodiments, when displaying a beverage amount (S400), a beverage area A may be displayed together with a beverage height H. If a large amount of beverage remains, a lateral width of the information displayed may be large, and if a small amount of beverage remains, a lateral width of the information may be small. That is, when the display 20 displays a beverage amount in a bar graph, a height of the bar graph is higher to indicate a large amount of beverage and a lateral width of the bar graph is wider to indicate a large beverage area.

Figure 15:
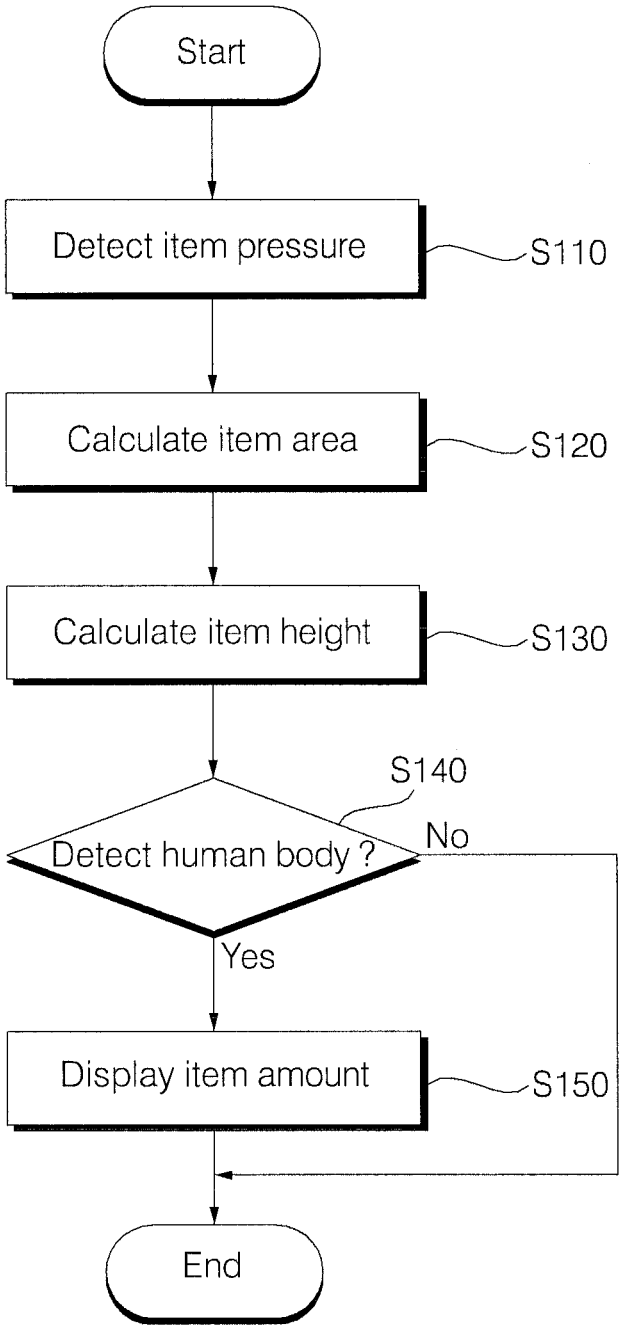
FIG. 15 is a flowchart of a method of operating a refrigerator according to another exemplary embodiment as broadly described herein.

FIG. 15 is a flowchart of a method of operating a refrigerator according to another exemplary embodiment, including detecting a beverage amount (S110, S120, and S130), and displaying a beverage amount (S140 and S150) using the human body detection sensor 91. First, a beverage pressure is detected (S110), a beverage area is calculated (S120) and a beverage height is determined (S130) in a manner similar to the exemplary embodiment discussed above with respect to FIG. 14. However, in this embodiment, even if a height and area of a beverage are calculated (S110, S120, and S130), if a human body is not detected, the calculated height and area of the beverage are not displayed on the display 20. If a human body is detected, the calculated height and area of the beverage are displayed on the display 20. More specifically, if a human body is detected (S140), the calculated height and area of the beverage are continuously displayed (S150). However, if a human body is no longer detected, or, if a preset time period (for example, 1 minute) has elapsed without a human body being detected (S140), the display 20 is turned off and the display 20 is not visible.

Figure 16:
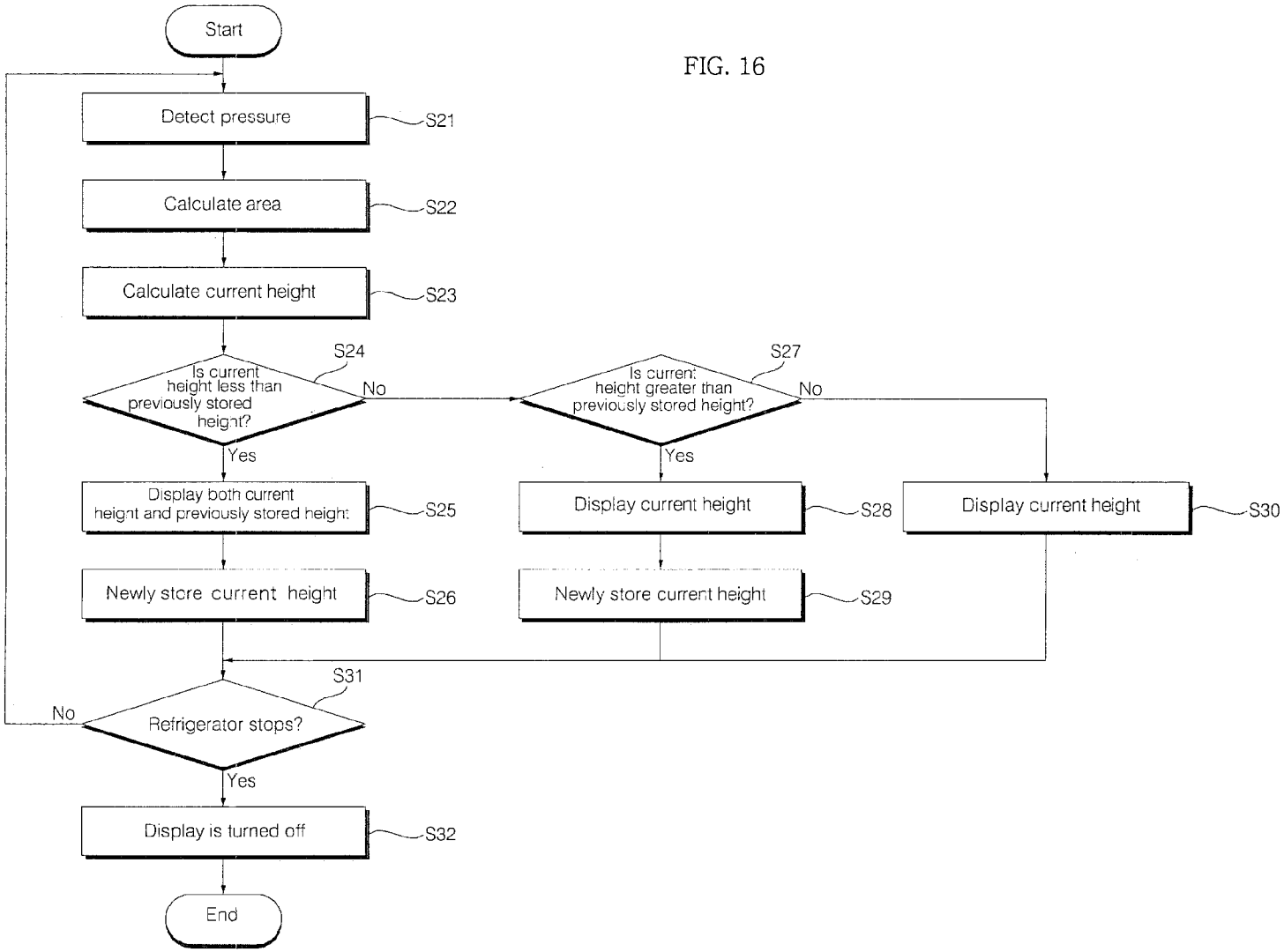
FIG. 16 is a flowchart of a method of operating a refrigerator according to another exemplary embodiment as broadly described herein.

FIG. 16 is a flowchart of a method of operating a refrigerator according to another exemplary embodiment, including detecting a beverage amount (S21, S23, and S23) and displaying a beverage amount (S24, S25, S26, S27, S28, S29, and S30), in a similar manner to that discussed above with respect to FIGS. 14 and 15. However, in this embodiment, if an amount of a beverage is varied by, for example, removing a beverage from the refrigerator, consuming some of the beverage, and replacing the beverage in the refrigerator, the method also includes displaying information on whether the beverage amount is varied and a degree of variation.

In this embodiment, if a beverage amount decreases, both a previous beverage amount (before the beverage amount decreased) and a decreased beverage amount are displayed on the display 20. Similarly, if a beverage amount increases, an increased beverage amount is displayed on the display 20, and if a current beverage amount is substantially the same as a previous beverage amount, the previous beverage amount is displayed on the display 20.

Once a beverage height is determined (S21, S22 and S23) a beverage amount is displayed by comparing a detected height of the beverage with a previously stored height of the beverage and determining whether an amount of the beverage is increased/decreased/sustained (S24 and S27), determining whether both the detected height of the beverage and a previously stored height of the beverage are displayed (S25), or whether the detected height of the beverage is displayed (S28 and S30), and storing a new beverage height (S26 and S29).

In certain embodiments, a previously stored height of the beverage may be set to '0' when a beverage height is first detected after power is applied to the refrigerator, and then, if a new beverage height has been detected, the newly detected height of the beverage may be updated and stored (S26 and S29).

In particular, if a currently detected height of the beverage is less than a previously stored height of the beverage, it is determined that a beverage amount has decreased, and both the currently detected height of the beverage and the previously stored height of the beverage are displayed (S24 and S25). The previously stored height and the currently detected height may be displayed differently on the display 20 using, for example, different colors or different luminance levels so as to distinguish between the two amounts. The currently detected height then replaces the previously stored height of the beverage and is stored as the previously stored height (S26).

If a currently detected height of the beverage is greater than a previously stored height of the beverage (S24), it is determined that the beverage has been newly added or replaced (S27), and thus only a currently detected height of the beverage is displayed (S28). The previously stored height of the beverage is updated to the currently detected height of the beverage and is stored (S29).

If a currently detected height of the beverage is identical to a previously stored height of the beverage, it is determined that the beverage amount has not varied, and only a current beverage height is displayed (S30). The currently detected height of the beverage is not updated and a previously stored height of the beverage is sustained.

When the most recently detected beverage amount is displayed differently from the previous beverage amount (S25), the most recently detected beverage amount may be displayed at a luminance level greater than that of a previous beverage amount. Alternatively, a most recently detected beverage amount may be displayed with a color that is brighter or different than that of a previous beverage amount. Other means for distinguishing the previous and current beverage amounts may also be appropriate.

If the beverage amount decreases, a luminance level of light radiated by LEDs of an area corresponding to the decreased amount of the beverage may be lowered compared to the previous beverage height. In this case, a luminance level of a lower part (the currently detected beverage amount) may be lower than a luminance level of an upper part (consumed beverage amount), so that a consumed amount of the beverage, which has a higher luminance level is easily visible. These luminance levels may be reversed with the consumed beverage amount displayed at a lower luminance level, based on user preferences.

In certain embodiments, LEDS of the display 20 may be arranged in, for example, 10 vertically stacked rows to form a plurality of rows and columns. When light is radiated from LEDS in, for example, rows 1 through 8, starting from the lowest row, it may be determined that a beverage amount has decreased by approximately 20% from a previous case. In this case, luminance of LEDS in rows 9 and 10 may be lower than that of rows 1-8 of the LEDS. Thus, the user may determine a current beverage amount based on the brightness of a lower area and a decreased amount of the beverage based on the brightness of an upper area relative to the lower area.

Further, when the beverage amount decreases, a color of light radiated from LEDS of an area corresponding to a decrease amount of the beverage may be different from a previous color based on a previously displayed beverage height. In this case, a beverage amount detected at steps S21, S23, and S23 may sustain a previous color, and a color of an upper part (a consumed beverage amount) may be different (darker or lighter) than that of a lower part (the detected beverage amount).

This allows a user to easily determine a consumed degree of a beverage based on a height of an upper part having a color, luminance or brightness different from that of a lower part, and to easily determine an amount of the remaining beverage.

The method shown in FIG. 16 also includes turning off the display 20 (S32) if the refrigerator is stopped (S31).

Figure 17:
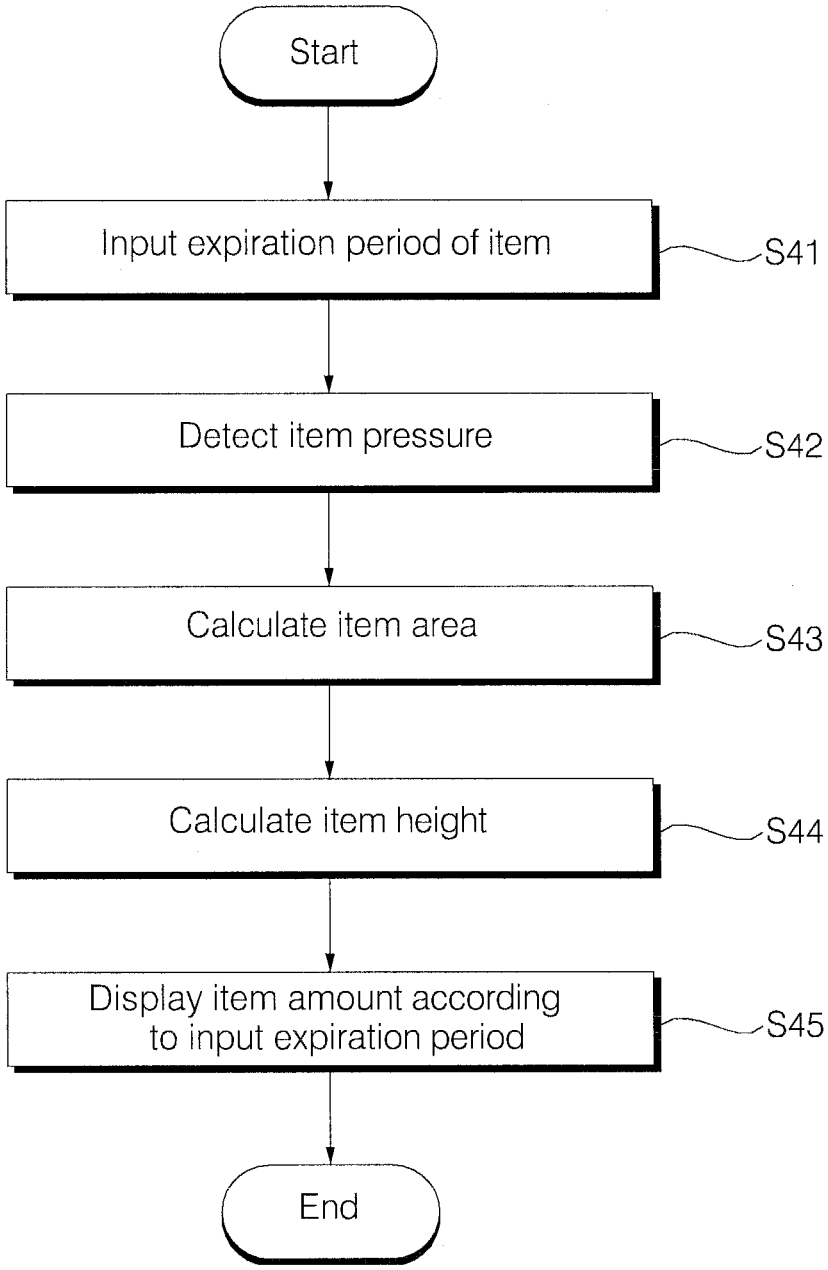
FIG. 17 is a flowchart of a method of operating a refrigerator according to another exemplary embodiment as broadly described herein.

FIG. 17 is a flowchart of a method of operating a refrigerator according to another exemplary embodiment as broadly described herein.

The method includes an input step (S41), at which the user inputs an expiration period using, for example, an expiration period input device associated with the manipulation device 60, the touch screen 62, or other input device as appropriate. The expiration period may be, for example, a difference between an expiration period provided on a beverage container and a date on which the container is stored in the refrigerator. After inputting the expiration period (S41), the steps of determining a beverage pressure, area and height (S42, S43, and S44) are similar to the embodiment discussed above with respect to FIG. 14.

The controller 70 may control the display 20 (S45) so that a display color or a display state of the display 20 is different based on an expiration period of a beverage input at input step (S41). For example, when displaying a beverage amount (S45), the controller 70 may control the display 20 so that a color of the display 20 before arriving an expiration period and a color of the display 20 after arriving an expiration period are different.

Alternatively, when displaying a beverage amount (S45), the controller 70 may control the display 20 so that a color of the display 20 during a period from a date of executing input step (S41) to a set expiration date is different.

Alternatively, when displaying a beverage amount (S45), the controller 70 may control the display 20 so that a color of the display 20 gradually approaches a specific color until a date of an expiration period, and then displays a specific color after an expiration period has elapsed.

In more detail, the display 20 may display information in, for example, a red color after an expiration period has elapsed, in, for example, an orange color at a date of an expiration period with, and in, for example, an orange color prior to an expiration period. Within a period of, for example, two days of an expiration period, information may be displayed with, for example, a white color. Then if display information displayed with a white color is changed to a yellow color, the user may determine that an end of an expiration period is approaching. Likewise, if display information displayed with a yellow color is changed to an orange color, the user may determine that an expiration period has arrived, and if display information is changed to a red color at the next day of an expiration period, the user determine that an expiration period has elapsed.

When displaying a beverage amount (S45), by varying a color of the display 20, in addition to displaying that an expiration period is approaching or has elapsed, arrival or elapse of an expiration period may be indicated based on an on/off period of the display 20. That is, when displaying a beverage amount (S45), the controller 70 may control the display 20 to display a first display state before arriving at the end an expiration period and a second display state after arriving at the end an expiration period. The controller 70 may also control the display 20 to display a different display state for a first period, between a date of executing the input step (S41) and a set date, and a second period, between the set date and a date of an expiration period.

The controller 70 may also control the display 20 so that a display state of the display 20 gradually varies until an expiration period has elapsed from a date of executing the input step (S41). In more detail, the display 20 may be quickly turned on/off at a first speed after an expiration period has elapsed, turned on/off at a second speed that is relatively slower than the first speed at a date of an expiration period, turned on/off at a third speed that is relatively slower than the second speed at a date prior to an expiration period, and then held in a sustained on-state for two days before an expiration period. If the display 20 is turned on/off at the third speed, the user determines that an expiration period approaches. If the display information turned on/off at the third speed is changed to the second speed, the user determines that an expiration period arrives, and if display information is turned on/off at the first speed, the user determines that an expiration period has elapsed.

As described above, in addition to varying of a color or varying of an on/off period, information of an expiration period may be displayed using a difference in luminance level of light radiated from an LED.

Figure 18:
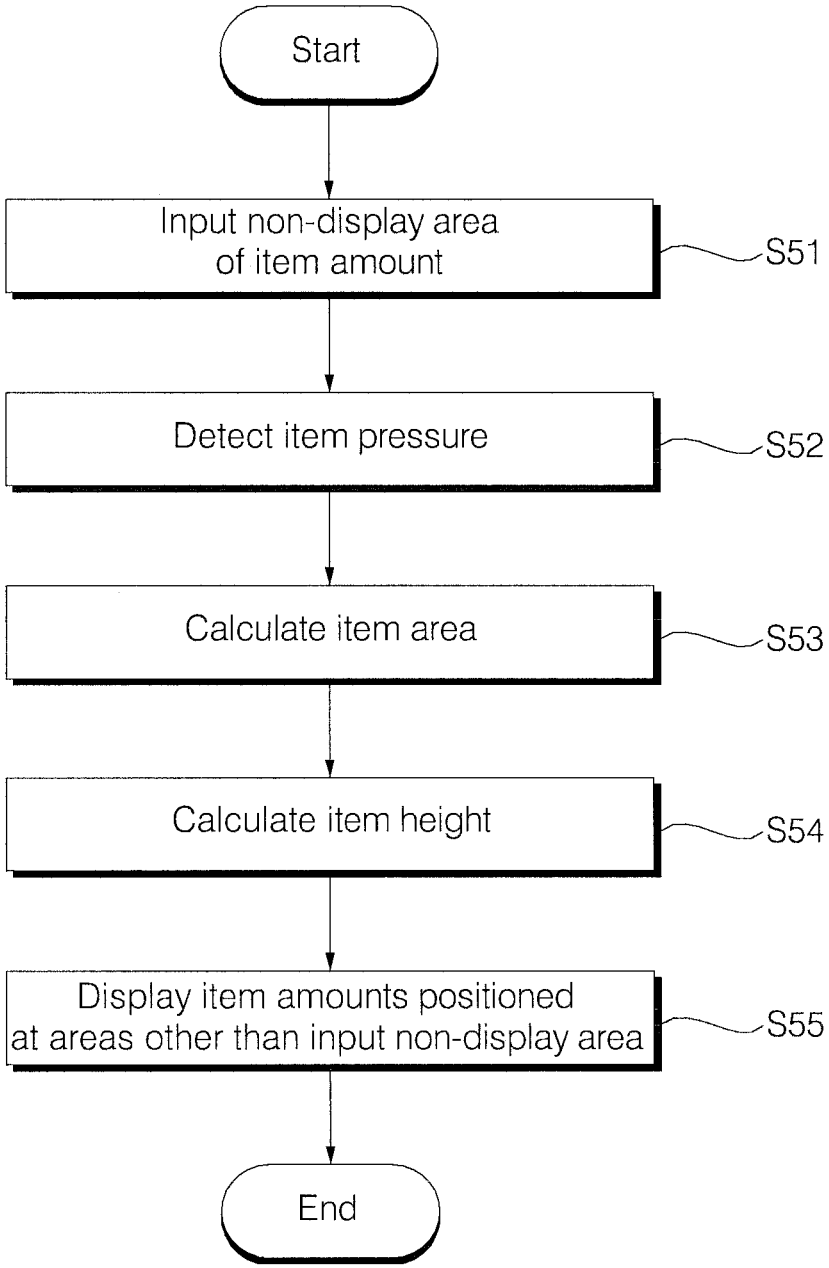
FIG. 18 is a flowchart of a method of operating a refrigerator according to another exemplary embodiment as broadly described herein.

FIG. 18 is a flowchart of a method of operating a refrigerator according to another exemplary embodiment as broadly described herein. The method includes an input step (S51), determining a beverage pressure, area and height to detect a beverage amount (S52, S53, and S54), and displaying a beverage amount (S55).

At the input step (S51), when the user places a beverage in the refrigerator for storage, an area in which the user does not want a beverage amount to be displayed may be input through the manipulation device 60 or the touch screen 62. Determining a beverage pressure, area and height so as to detect a beverage amount (S52, S53, and S54) are similar to detecting a beverage amount as discussed above with respect to FIG. 14. When displaying a beverage amount (S55), the controller 70 turns off all LEDS corresponding to a non-display area of the display 20 and turns on only LEDS corresponding to the remaining area, based on a remaining beverage amount.

For example, if the basket 18 is segregated into a left area, a central area, and a right area, and the left area is input as a non-display area through the manipulation device 60, the controller 70 divides a plurality of LED groups of the display 20 into a left LED group, a central LED group, and a right LED group. The controller 70 then turns off the left LED group corresponding to the left area, which has been input as a non-display area at input step (S51), and turns on the central LED group and the right LED group, which are the remaining LED groups, and displays a corresponding beverage amount in each.

Figure 19:
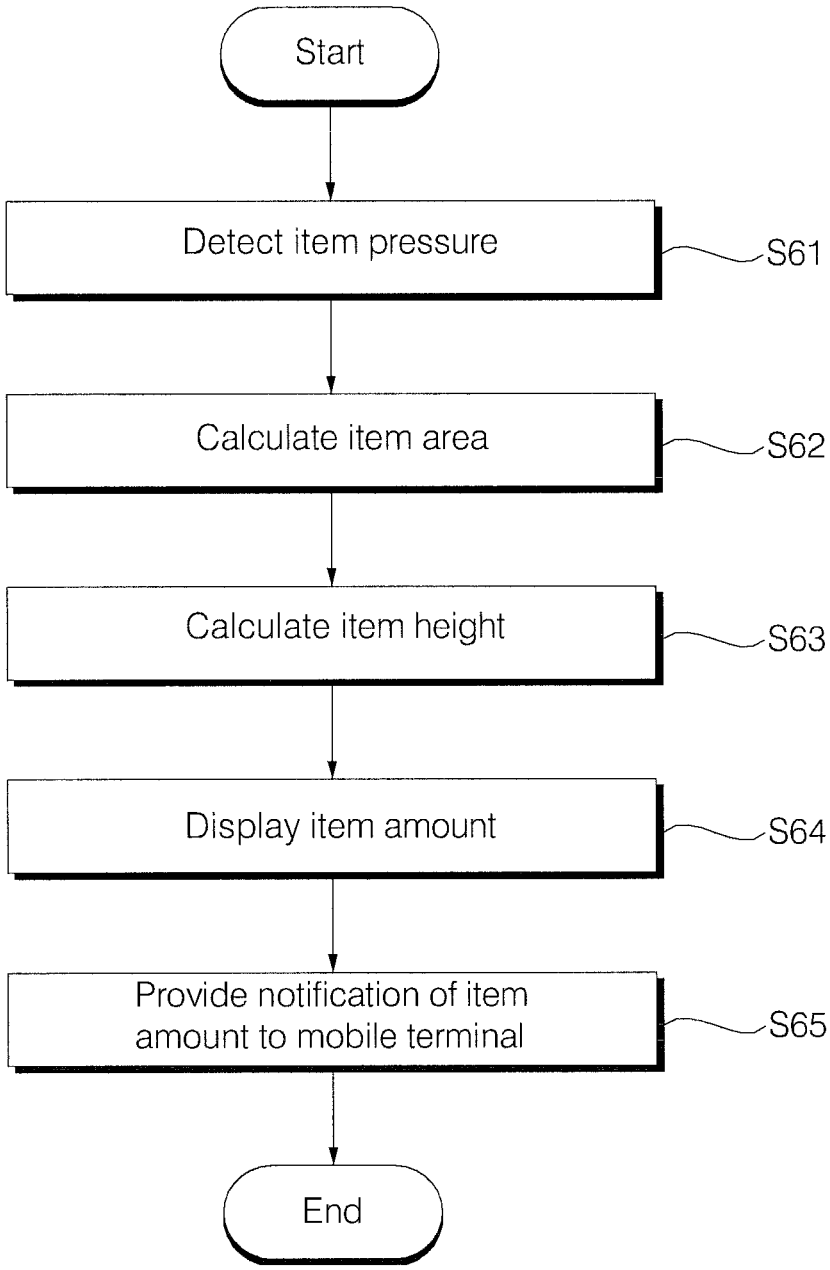
FIG. 19 is a flowchart of a method of operating a refrigerator according to another exemplary embodiment as broadly described herein.

FIG. 19 is a flowchart of a method of operating a refrigerator according to another exemplary embodiment as broadly described herein. The method shown in FIG. 19 includes determining a beverage pressure, area and height to detect a beverage amount (S61, S62, and S63), similar to that discussed above with respect to FIG. 14, displaying a beverage amount (S64), similar to that discussed above with respect to FIG. 14, and providing notification of a beverage amount (S65).

When providing notification of a beverage amount (S65), if the user is not located where the refrigerator is installed, a signal regarding a remaining beverage amount may be transmitted to a predetermined location, such as, for example, a mobile terminal, or other location capable of receiving such a signal. Such a signal may be output to a communication device installed at or connected to the refrigerator to transmit the signal regarding a remaining beverage amount to a mobile terminal connected to a communication network or other such receiving device user may then determine whether refilling of the beverage is required by checking the beverage amount, even when not located where the refrigerator is installed.

A refrigerator is provided that can display an amount of a beverage stored in the refrigerator to the outside.

A method of operating a refrigerator is provided that can easily notify a user an amount of a beverage stored in the refrigerator.

A refrigerator as embodied and broadly described herein may include a main body having a storage chamber; a cooling device for cooling the storage chamber; a door for opening and closing the storage chamber; a basket installed at the door; a pressure sensor for detecting a pressure of a beverage put on the basket; a controller for outputting a control signal according to the detected result of the pressure sensor; and a display installed at the door and for displaying an amount of a beverage according to a signal output from the controller.

The door may include a front cover in which a decoration portion is formed, and the display may be disposed at the rear of the front cover, and when the display is turned off, the display may be covered by the decoration portion, and when the display is turned on, the display may display an amount of the beverage on the decoration portion.

The display may include a display PCB and a plurality of LEDS installed at the display PCB to radiate light toward the decoration portion.

The refrigerator may also include a human body detection sensor installed at the door to detect a human body, wherein when the human body is detected by the human body detection sensor, the controller may output a control signal to the display so that the display displays an amount of a beverage.

The door may also include a main door having an opening and a home bar door installed at the main door to open and close the opening, the basket may be positioned at the lower side of the rear of the opening, and the display may be installed at the home bar door.

The display may display an amount of the beverage in a bar graph.

The display may display an amount of the beverage together with a height of the beverage.

The display may display an area of the beverage as a height of the beverage.

A refrigerator in accordance with another embodiment as broadly described herein may include a main body having a storage chamber; a cooling device for cooling the storage chamber; a door for opening and closing the storage chamber; a beverage amount detection unit for detecting an amount of a beverage placed into and stored in the storage chamber; and a display for displaying an amount of a beverage detected by the beverage amount detection unit.

A method of operating a refrigerator as embodied and broadly described herein may include detecting, by a beverage amount detection unit installed at the refrigerator, an amount of a beverage; and displaying, by the display installed at the refrigerator, the detected beverage amount.

The detecting of an amount of a beverage may include: detecting a pressure of the beverage; and calculating a beverage amount from the detected beverage pressure.

The displaying of the detected beverage amount may include displaying the detected beverage amount as a height.

The displaying of the detected beverage amount may include displaying the detected beverage amount as an area together with a height.

The displaying of the detected beverage amount may be executed when a human body detection sensor installed at the refrigerator detects a human body.

The detecting of an amount of a beverage and the displaying of the detected beverage amount may be repeated, and the displaying of the detected beverage amount may include differently displaying, if the detected beverage amount is less than a previous beverage amount, the detected beverage amount and a previous beverage amount.

The displaying of the detected beverage amount may include displaying the detected beverage amount and a previous beverage amount with different luminance.

The displaying of the detected beverage amount may include displaying a color of the detected beverage amount with a color different from that of a previous beverage amount.

The method may also include inputting an expiration date of a beverage injected to the refrigerator, wherein the displaying of the detected beverage amount includes displaying information about the expiration date of a beverage.

The displaying of the detected beverage amount may include displaying information about the expiration date by varying a color of the display.

The method may also include inputting a non-display area in which a beverage amount is not displayed at space to which the beverage is injected, wherein the displaying of the detected beverage amount includes displaying a beverage amount of the remaining area other than the non-display area.

In a system and method as embodied and broadly described herein, when a beverage is placed into the refrigerator for storage, a beverage amount is detected and the detected beverage amount is visually displayed at a front surface of the refrigerator, so that a user can determine a beverage amount without opening a door, thereby improving use convenience of the refrigerator.

Further, when the display is turned on, the display displays a beverage amount on a decoration portion of the door and thus the beverage amount is displayed on a decoration portion, and when the display is turned off, the display is not viewed from the outside of the refrigerator and is hidden by the door, and thus the display can have an appearance of a single body with the door and provide an enhanced external appearance.

Further, when the user approaches the refrigerator, the display displays beverage information and thus power consumption of the display can be minimized.

Further, because the display displays a beverage amount as a beverage height, a substantial amount of a beverage can be determined more easily than when displaying the beverage amount as a percent.

Further, because the display also displays a beverage area, a substantial amount of a beverage can be determined more accurately.

Further, because the display displays a beverage amount with a bar graph, the user can easily visually determine a height and an area of a beverage.

Further, because the display is installed at a home bar door, service of the display can be easily performed.

Further, a pressure sensor includes a plurality of pressure detection elements disposed with a plurality of rows and a plurality of columns at a basket, and can detect both an area and a height of a beverage and accurately detect a beverage amount.

Further, the pressure sensor includes a plurality of pressure detection elements separately disposed, and because a beverage amount detected by each of the plurality of pressure detection elements is displayed on a beverage basis, a plurality of beverage amounts can be simultaneously detected and displayed.

Further, because the display can display both a beverage amount and a decrease degree of a beverage, the user can easily know the propensity to consume of the beverage.

Further, because a color or a state of display information for displaying a beverage amount can be differently displayed according to an expiration period of a beverage, the user can easily determine information about an expiration period as well as information about a beverage amount.

Further, because the user can select a detection area of a beverage amount, the user can be variously selected, and power consumption can be minimized.

Further, because a beverage amount is transmitted to a mobile terminal, the beverage amount within the refrigerator can be determined at outdoors, thereby improving use convenience of the refrigerator.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A refrigerator, comprising:

a main body having a storage chamber formed therein;

a door that opens and closes the storage chamber;

a basket installed on the door and configured to receive a storage item therein;

a pressure sensor that detects a pressure applied by the storage item received in the basket;

a controller that outputs a control signal based on the pressure detected by the pressure sensor; and an LED display installed in one of the door or the main body, wherein the display displays a residual amount of the storage item based on the control signal output by the controller, wherein the display displays the residual amount of the storage item as a height and an area together in the form of a bar graph, wherein the area is indicative of the area of the storage item determined based on the detected pressure, and wherein the height is indicative of the height of the storage item, determined by determining the item volume based on the detected pressure corresponding to the mass of the item, and a preset density of the item, and dividing the volume by the area.

2. The refrigerator of claim 1, wherein the door comprises a front cover including a decoration portion, and wherein the display is positioned to a rear of the front cover such that when the display is turned off, the display is obscured by the decoration portion, and when the display is turned on, the display displays the residual amount on the decoration portion.

3. The refrigerator of claim 2, wherein the display comprises a PCB and a plurality of LEDS installed on the PCB so as to selectively radiate light toward the decoration portion.

4. The refrigerator of claim 1, further comprising a detection sensor installed at the door and configured to detect at least one of motion and/or heat associated with a human body, wherein the control signal output by the controller controls the display so that the display displays the residual amount in response to detection of motion and/or heat by the detection sensor.

5. The refrigerator of claim 1, wherein the door comprises a main door having an opening formed therein, and a home bar door installed at the main door so as to open and close the opening, wherein the basket is aligned with a lower end of the opening such that storage items stored therein are accessible through the opening, and wherein the display is installed at the home bar door.

6. A method of operating a refrigerator, the method comprising:

detecting a storage amount of an item stored in the refrigerator based on a measurement taken by an amount detector installed in the refrigerator, wherein detecting the storage amount comprises:

detecting pressure applied to a plurality of pressure elements of the amount detector by the item;

determining a weight of the item based on the detected pressure; and determining a height corresponding to the determined weight;

wherein determining the height comprises:

determining a volume of the item based on a mass corresponding to the determined weight and dividing the mass by a preset density; and determining an area of the item based on the pressure applied to the plurality of pressure elements; and dividing the determined volume by the determined area to determine the height of the item; and displaying the detected storage amount on a display installed on the refrigerator, comprising displaying the detected storage amount as a height and an area together in the form of a bar graph, wherein the height and area are indicative of the height and area of the item, respectively.

7. The method of claim 6, wherein displaying the detected storage amount is executed when a detection sensor installed at the refrigerator detects motion and/or heat associated with a human body.

8. The method of claim 6, wherein detecting a storage amount and displaying the detected storage amount are repeated, and wherein displaying the detected storage amount comprises displaying both a previous storage amount and a currently detected storage amount if the currently detected storage amount is less than the previous storage amount.

9. The method of claim 8, wherein displaying both the previous storage amount and the currently detected storage amount comprises displaying the previous storage amount and the currently detected storage amount differently.

10. The method of claim 9, wherein displaying the previous storage amount and the currently detected storage amount differently comprises displaying the currently detected storage amount and the previous storage amount at different luminance levels.

11. The method of claim 9, wherein displaying the previous storage amount and the currently detected storage amount differently comprises displaying the currently detected storage amount in a first color and the previous storage amount in a second color.

12. The method of claim 6, further comprising receiving an expiration date of an item stored in the refrigerator, wherein displaying the detected storage amount comprises displaying information related to the expiration date of the item.

13. The method of claim 12, wherein displaying the detected storage amount comprises displaying information related to the expiration date by varying a color of the display.

14. The method of claim 6, further comprising receiving a non-display area command that defines an area in the refrigerator for which a storage amount is not displayed, wherein displaying the detected storage amount comprises displaying a storage amount of remaining areas other than the non-display area.

* * * * *

UNITED STATES PATENT AND TRADEMARK OFFICE

CERTIFICATE OF CORRECTION

PATENT NO. : 8,638,224 B2
APPLICATION NO. : 12/827460
DATED : January 28, 2014
INVENTOR(S) : Se Re Bak It is certified that error appears in the above-identified patent and that said Letters Patent is hereby corrected as shown below:

Title Page, Item (12) delete "Park" and insert --Bak--.

Title Page, Item (75) Inventor should read as follows: Se Re Bak, Seoul (KR)

Signed and Sealed this
Thirty-first Day of March, 2015

Michelle K. Lee

Michelle K. Lee
*Director of the United States Patent and Trademark Office*